US008044982B2

(12) United States Patent
Takahashi

(10) Patent No.: US 8,044,982 B2
(45) Date of Patent: Oct. 25, 2011

(54) ELECTRO-OPTICAL DEVICE

(75) Inventor: Nariya Takahashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 621 days.

(21) Appl. No.: 12/249,450

(22) Filed: Oct. 10, 2008

(65) Prior Publication Data

US 2009/0135209 A1 May 28, 2009

(30) Foreign Application Priority Data

| | | |
|---|---|---|
| Nov. 28, 2007 | (JP) | 2007-307627 |
| Mar. 7, 2008 | (JP) | 2008-057402 |
| Mar. 7, 2008 | (JP) | 2008-057409 |
| May 20, 2008 | (JP) | 2008-132209 |

(51) Int. Cl.
*G09G 5/10* (2006.01)

(52) U.S. Cl. ..... 345/690; 345/80

(58) Field of Classification Search ..... 345/690
See application file for complete search history.

(56) References Cited

U.S. PATENT DOCUMENTS

| | | | | |
|---|---|---|---|---|
| 4,795,239 | A | 1/1989 | Yamashita et al. | |
| 7,355,576 | B2 * | 4/2008 | Song | 345/87 |
| 2002/0154085 | A1 * | 10/2002 | Kim | 345/96 |
| 2007/0139344 | A1 * | 6/2007 | Zheng et al. | 345/98 |

FOREIGN PATENT DOCUMENTS

| | | |
|---|---|---|
| JP | A 62-049399 | 3/1987 |
| JP | A-1-167734 | 7/1989 |
| JP | A 2003-114661 | 4/2003 |
| JP | A-2006-162708 | 6/2006 |

* cited by examiner

*Primary Examiner* — Richard Hjerpe
*Assistant Examiner* — Sahlu Okebato
(74) *Attorney, Agent, or Firm* — Oliff & Berridge, PLC

(57) ABSTRACT

A driving circuit of an electro-optical device that includes scanning lines divided into two or more groups and two or more common electrodes that correspond to the two or more groups of scanning lines. The driving circuit includes a data line driving circuit and a common signal supply circuit. The driving circuit divides one field of one of the pixels into sub-fields and applies the one of the pixels with on or off voltages during the sub-fields to achieve a desired gray-scale level. During one specific sub-field, the data line driving circuit supplies a data signal of an off voltage regardless of the gray-scale level for the pixel. After the specific sub-field ends, the common signal supply circuit switches a voltage applied to a common electrode of that corresponds to the group of scanning lines that includes the selected scanning line.

8 Claims, 18 Drawing Sheets

FIG. 5

| GRAY-SCALE LEVEL | SUB-FIELD | | | | |
|---|---|---|---|---|---|
| | sf0 | sf1 | sf2 | sf3 | sf4 |
| 15 | off | off | off | off | off |
| 14 | off | on | off | off | off |
| 13 | off | off | on | off | off |
| 12 | off | on | on | off | off |
| 11 | off | off | off | on | off |
| 10 | off | on | off | on | off |
| 9 | off | off | on | on | off |
| 8 | off | on | on | on | off |
| 7 | off | off | off | off | on |
| 6 | off | on | off | off | on |
| 5 | off | off | on | off | on |
| 4 | off | on | on | off | on |
| 3 | off | off | off | on | on |
| 2 | off | on | off | on | on |
| 1 | off | off | on | on | on |
| 0 | off | on | on | on | on |

BRIGHT ↑

DARK ↓

NORMALLY WHITE MODE

ELECTRO-OPTICAL DEVICE

BACKGROUND

1. Technical Field

The present invention relates to a technology for performing a gray scale in such a manner that one field is divided into a plurality of sub-fields and pixels are caused to enter an on state or an off state in each sub-field.

2. Related Art

When the grayshade is performed in an electro-optical device that uses display elements, such as liquid crystal capacitors, in pixels, the following technology has been suggested as a substitute for a voltage modulation method. That is, there has been suggested a technology for performing halftone display in such a manner that one field is divided into a plurality of sub-fields and then the pixels (liquid crystal capacitors) are caused to enter an on state or an off state in each divided sub-field to thereby change the percentage of a time period during which the pixels are caused to enter an on state or an off state within the one field, which is described in JP-A-2003-114661. On the other hand, each liquid crystal capacitor is configured so that a liquid crystal is held between a common electrode and a pixel electrode. In order to suppress the voltage amplitude of a data line (source line), it has been suggested that the common electrode is alternately switched between a low-level voltage and a high-level voltage, which is described in JP-A-62-49399.

However, in a case where driving is performed in such a manner that one field is divided into a plurality of sub-fields, when a technology for alternately switching the voltage of the common electrode is employed, there occurs a problem such as a deterioration in contrast ratio or a decrease in the number of addressable gray-scale levels. An advantage of some aspects of the invention is that it provides a technology, or the like, for improving a deterioration in contrast ratio or a decrease in the number of addressable gray-scale levels when driving is performed in such a manner that one field is divided into a plurality of sub-fields and the voltage of the common electrode is alternately switched.

SUMMARY

An advantage of some aspects of the invention is that it provides a technology, or the like, for improving a deterioration in contrast ratio or a decrease in the number of addressable gray-scale levels when driving is performed in such a manner that one field is divided into a plurality of sub-fields and the voltage of the common electrode is alternately switched.

An aspect of the invention provides a driving circuit of an electro-optical device. The electro-optical device includes pixels that are provided at positions corresponding to intersections of a plurality of scanning lines and a plurality of data lines. Each of the pixels includes a pixel switching element, a pixel electrode, and a liquid crystal. One end of the pixel switching element is electrically connected to a corresponding one of the data lines, and the pixel switching element enters a conductive state between the one end and the other end thereof when a selection voltage is applied to a corresponding one of the scanning lines. The pixel electrode is electrically connected to the other end of the pixel switching element. The liquid crystal is held between the pixel electrode and a common electrode to which a common signal is applied. The common electrodes are divided so as to correspond to two or more groups, each of which includes predetermined lines of the plurality of scanning lines. For the electro-optical device, the driving circuit divides one field of the pixels corresponding to the scanning lines into a plurality of sub-fields and applies the pixels with an on or off voltage by the sub-fields. The driving circuit includes a common signal supply circuit, a scanning line driving circuit, and a data line driving circuit. The common signal supply circuit supplies a common signal of either one of a first voltage and a second voltage different from the first voltage to each of the common electrodes corresponding to the groups. The scanning line driving circuit selects n (n is an integer that is larger than or equal to 2) scanning lines that are located a distance away from each other among the plurality of scanning lines, sequentially applies a selection voltage to the selected n scanning lines and then shifts the n scanning lines by one line, respectively, to select n scanning lines in the next period, or sequentially selects the plurality of scanning lines and applies a selection voltage to the selected scanning line to thereby apply the selection voltage to the scanning lines for each of periods corresponding to the plurality of sub-fields. The data line driving circuit supplies the pixels, which are located on the scanning line to which the selection voltage is applied, with an on or off voltage, as a data signal, corresponding to a corresponding one of the sub-fields and gray-scale levels specified for the pixels, through the data lines. The data line driving circuit supplies data signals of an off voltage in one specific sub-field among the plurality of sub-fields irrespective of the gray-scale levels. The common signal supply circuit switches a voltage of the common electrode that corresponds to the group, for which application of the off voltage in the specific sub-field ends, from one of a first voltage or second voltage to the other of the first voltage or second voltage. According to the aspect of the invention, it is possible to shorten the period of the specific sub-field in which an off voltage is maintained irrespective of the gray-scale levels.

Here, in the aspect of the invention, the number of the scanning lines that form each group may be equal. That is, the plurality of scanning lines may be grouped by predetermined lines. Note that as the number of groups is small, it is less effective to shorten the period of the specific sub-field. On the other hand, as the number of groups is large, it is more effective to shorten the period of the specific sub-field; however, the configuration can be complex. In addition, in the aspect of the invention, the sub-field having the shortest period among the plurality of sub-fields, into which the one field is divided, except the specific sub-field may be arranged following the specific sub-field. When an on or off voltage is applied in a sub-field, the holding state in the preceding sub-field more influences the shorter the period of the sub-field is. Because an off voltage is definitely applied in the specific sub-field irrespective of the gray-scale levels, when the sub-field having the shortest period among the plurality of sub-fields except the specific sub-field is arranged following the specific sub-field, it is possible to eliminate the influence due to the holding state in the preceding sub-field.

Note that the aspect of the invention is not limited to the driving circuit of the electro-optical device; but it may be regarded as the electro-optical device by itself, an electronic apparatus that includes the electro-optical device, a method of driving the electro-optical device, and a method of manufacturing a substrate of the electro-optical device. Here, when it is regarded as the electro-optical device, the liquid crystal may be held between a first substrate on which the pixel electrodes are provided and a second substrate on which the common electrodes corresponding to the groups are provided, and the common electrodes each may have a slit portion that is open at a portion facing a gap between the adjacent pixel electrodes and that is provided for every or every other scanning lines belonging to each group. Owing to the slit portions, it is possible to eliminate a nonuniform distribution in electric field, which occurs due to the common electrode being divided into groups. Furthermore, the common electrode corresponding to one of the groups may have a surrounding portion outside an area in which the slit portions are provided.

In addition, when the aspect of the invention is regarded as a method of manufacturing a substrate of an electro-optical device, the electro-optical device includes a first substrate on which pixel electrodes are arranged in a matrix in a row direction and in a column direction, a second substrate on which common electrodes are provided and divided so as to correspond to two or more groups, each of which includes the pixel electrodes located on a plurality of rows, and a liquid crystal is held between the first substrate and the second substrate. The method of manufacturing the substrate of the electro-optical device includes forming a light shielding film in every or every other rows of the matrix arrangement at portions facing gaps between the adjacent pixel electrodes on a facing surface of a substrate body of the second substrate, which faces the first substrate; forming an insulating film so as to cover the light shielding film; planarizing the insulating film; forming a transparent conductive film on a surface of the planarized insulating film; and removing portions of the transparent conductive film, which overlap the light shielding film, to thereby form the common electrodes having slit portions. According to the above manufacturing method, it is possible to simply form a substrate that eliminates a nonuniform distribution in electric field, which occurs due to the common electrode being divided into groups, owing to the slit portions. At this time, it is applicable that after forming the transparent conductive film, a negative-type photoresist is formed so as to cover the transparent conductive film, light is irradiated to the substrate body from a side opposite to the facing surface to develop the photoresist, portions of the transparent conductive film, which overlap the pattern of the light shielding film, are exposed, and then the portions are etched when the common electrodes are formed.

BRIEF DESCRIPTION OF THE DRAWINGS

The invention will be described with reference to the accompanying drawings, wherein like numbers reference like elements.

FIG. 5 is a view that shows allocation of an on state or an off state to gray-scale levels and sub-fields.

DESCRIPTION OF EXEMPLARY EMBODIMENTS

Embodiments of the invention will be described with reference to the accompanying drawings. Note that, in the following description, a liquid crystal device, which is an example of an electro-optical device having a characteristic electrical configuration and driving method, will be described first, the mechanical configuration of the liquid crystal device, particularly the configuration of an opposite substrate, will be described second, a method of manufacturing the opposite substrate will be described third, and a projector, which is an example of an electronic apparatus that employs the liquid crystal device, will be described fourth.

1: Liquid Crystal Device

First, the electrical configuration and driving method of the liquid crystal device according to the embodiment will be described.

1-1: Circuitry of Liquid Crystal Device

Figure 1:
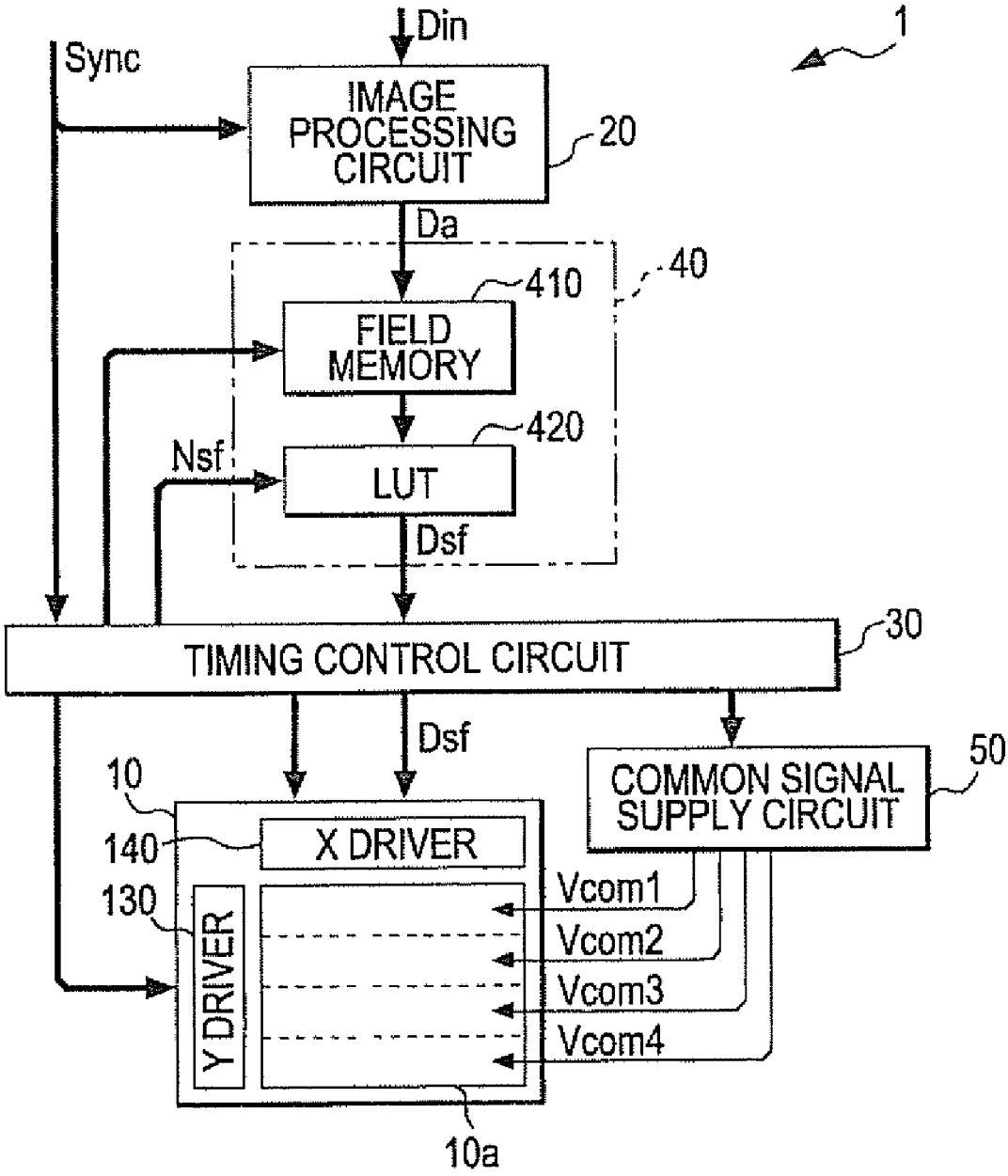
FIG. 1 is a block diagram that shows the electrical configuration of a liquid crystal device according to an embodiment.

FIG. 1 is a block diagram that shows the electrical configuration of the entire liquid crystal device. As shown in the drawing, the liquid crystal device 1 includes a display panel 10, an image processing circuit 20, a timing control circuit 30, a data conversion circuit 40 and a common signal supply circuit 50.

Figure 2:
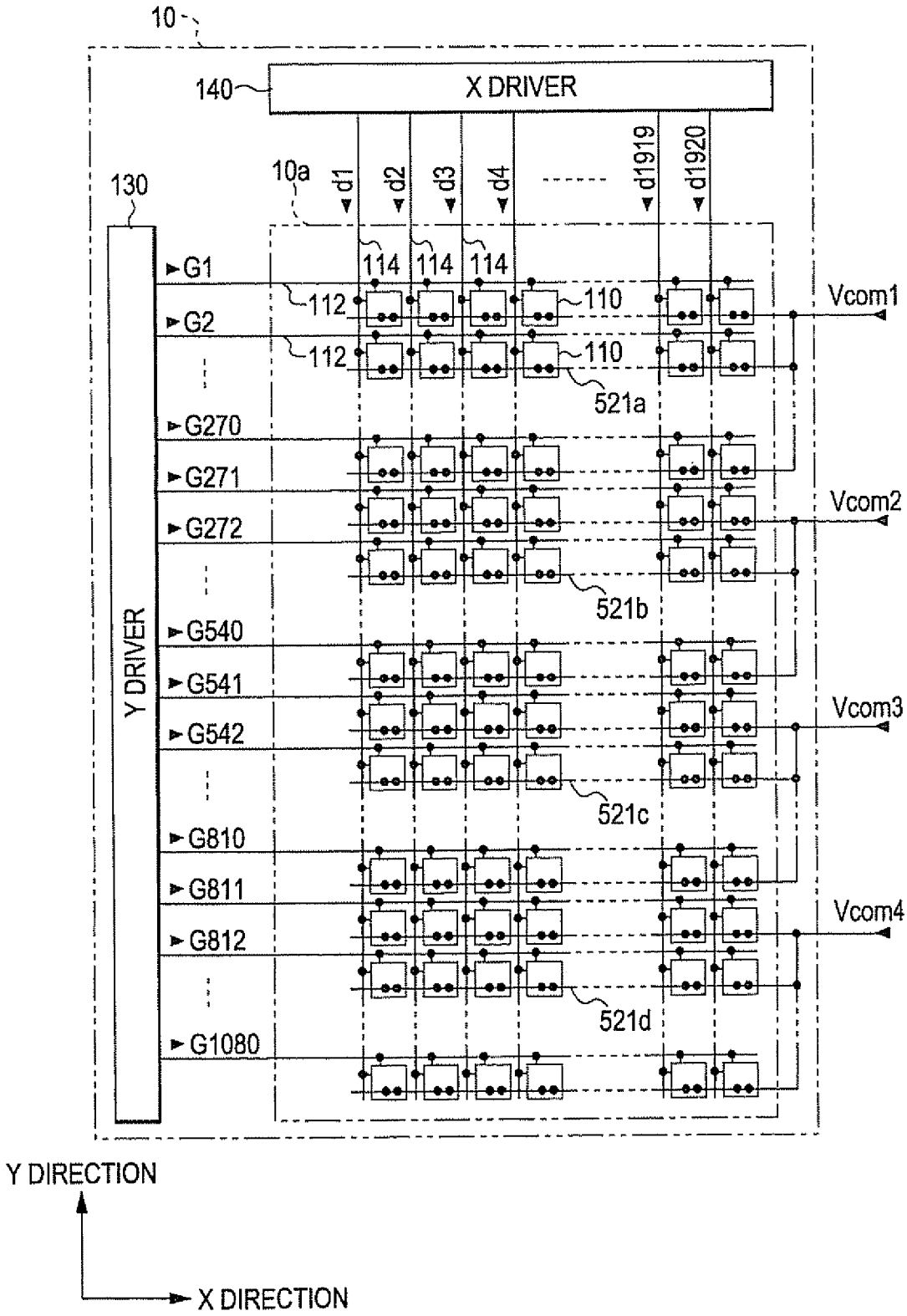
FIG. 2 is a circuit diagram that shows the electrical configuration of a display panel in the liquid crystal device.
Figure 3:
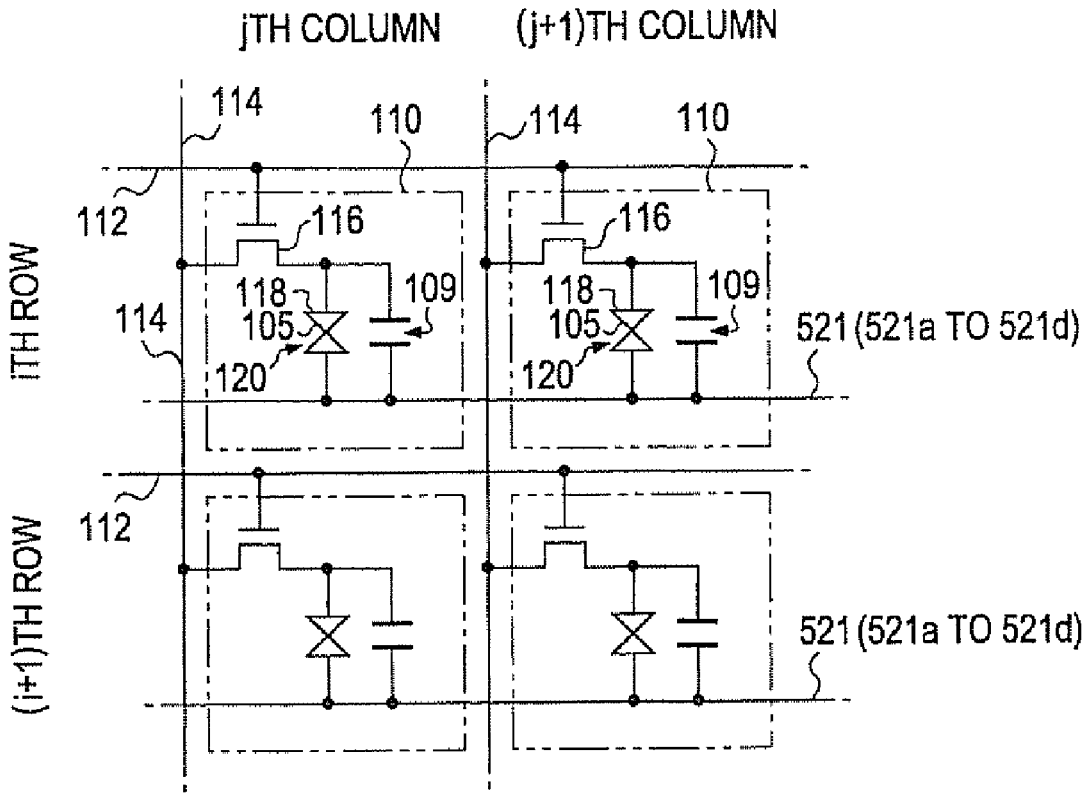
FIG. 3 is a circuit diagram that shows the electrical configurations of pixels in the display panel.

Of these components, the display panel 10 will be described first. FIG. 2 is a view that shows the circuitry of the display panel 10. FIG. 3 is a circuit diagram that shows the electrical configurations of pixels 110 in the display panel 10. As shown in FIG. 2, in the display area 10*a* of the display panel 10, 1080 scanning lines 112 are arranged so as to extend in a horizontal direction in the drawing, and 1920 data lines 114 are arranged so as to extend in a vertical direction in the drawing and maintain electrical insulation against the scanning lines 112. Furthermore, the pixels 110 are arranged at positions corresponding to intersections of the 1080 scanning lines 112 and the 1920 data lines 114. Thus, in the present embodiment, the pixels 110 are arranged in a matrix of 1080 rows by 1920 columns in a display area 10*a*. However, the aspects of the invention are not intended to be limited to the above arrangement. Note that the word "horizontal" and "vertical" are used to define two-dimensional arrangement direction; however, the concept of the "horizontal" and "vertical" is inverted when rotated by 90 degrees, for example. Therefore, in the following description, the direction in which the scanning lines 112 are arranged is set to a Y (row) direction, and the direction in which the data lines 114 are arranged is set to an X (column) direction.

Around the display area 10*a*, a Y driver (scanning line driving circuit) 130 that supplies a scanning signal to each of the scanning lines 112 and an X driver (data line driving circuit) 140 that supplies a data signal to each of the data lines 114 are arranged. For easier description, scanning signals supplied to the first, second, third, . . . , and 1080th scanning lines 112 are denoted as G1, G2, G3, . . . , and G1080. Similarly, data signals supplied to the first, second, third, . . . , and 1920th data lines 114 are denoted as d1, d2, d3, . . . , and d1920. Note that only one Y driver 130 is shown on one side with respect to the scanning lines 112 in FIG. 2 that shows the electrical configuration; two Y drivers may be provided on both sides, as will be described later.

FIG. 3 shows the configuration of two by two, four pixels in total, corresponding to intersections of the ith row, (i+1)th row located on the lower side and adjacent to the ith row, jth column and (j+1)th column located on the right side and adjacent to the jth column. Note that i and (i+1) are symbols when rows in which the pixels 110 are arranged are typically shown, and they are integers that range from 1 to 1080. In addition, j and (j+1) are symbols when columns in which the pixels 110 are arranged are typically shown, and they are integers that range from 1 to 1920.

As shown in FIG. 3, each pixel 110 includes an n-channel transistor 116, which serves as a pixel switching element, and a liquid crystal capacitor 120. Here, because each of the pixels 110 has the same configuration, the description of the configuration will be made representatively on the pixel 110 located at the ith row and jth column. In the ith row and jth column pixel 110, the gate electrode of the transistor 116 is connected to the ith scanning line 112, while the source electrode thereof is connected to the jth data line 114 and the drain electrode thereof is connected to a pixel electrode 118.

As will be described later, the display panel 10 is formed so that a pair of substrates, that is, an element substrate and an opposite substrate, are adhered to each other with a certain gap maintained therebetween, and a liquid crystal, which is an example of an electrooptic material, is sealed in the gap. Here, the scanning lines 112, the data lines 114, the transistors 116, the pixel electrodes 118, and the like, are formed on the element substrate, while the common electrode 521 is formed on the opposite substrate. The element substrate and the opposite substrate are adhered to each other with a certain gap so that the electrode forming faces of them face each other. Thus, in the present embodiment, each of the liquid crystal capacitors 120 is formed so that a liquid crystal 105 is held between the pixel electrode 118 and the common electrode 521.

In the present embodiment, the common electrode is divided into four by separating lines (separating groove portions, which will be described later) that extend in the X direction in which the scanning lines 112 extend as shown in FIG. 1 and FIG. 2. Specifically, as shown in FIG. 2, the common electrode 521 is divided into a first group common electrode 521*a* that corresponds to the first to 270th pixels, a second group common electrode 521*b* that corresponds to the 271st to 540th pixels, a third group common electrode 521*c* that corresponds to the 541st to 810th pixels and a fourth group common electrode 521*d* that corresponds to the 811th to 1080th pixels. Then, the first group common electrode 521*a* is supplied with a common signal Vcom1, the second group common electrode 521*b* is supplied with a common signal Vcom2, the third group common electrode 521*c* is supplied with a common signal Vcom3 and the fourth group common electrode 521*d* is supplied with a common signal Vcom4, from the common signal supply circuit 50, which will be described later. Note that the common electrodes will be described using the reference numeral 521 without suffix when a group is not specified.

In addition, the present embodiment is set to a normally white mode such that when an effective voltage value held in the liquid crystal capacitor 120 is approximate to zero, the transmittance ratio of light that passes through the liquid crystal capacitor becomes maximal and white display is performed, while as the effective voltage value increases, the amount of light transmitted decreases and, as a result, black display having the minimal transmittance ratio is performed. However, in the present embodiment, as will be described later, each liquid crystal capacitor 120 only attains either one of an on state and an off state.

In additions a storage capacitor 109 is provided for each pixel 110. One end of the storage capacitor 109 is connected to the pixel electrode 118 (drain of the transistor 116), while the other end thereof is electrically connected to a corresponding one group of the common electrodes 521 through a capacitor line and a conductive material, such as silver paste, for conduction between the opposite substrate and the element substrate. Thus, as shown in FIG. 3, the liquid crystal capacitor 120 and the storage capacitor 109 in each pixel 110 are equivalent to a state in which they are connected in parallel with each other between the drain electrode of the transistor 116 and the common electrode 521.

In the above configuration, as the Y driver 130 applies a certain scanning line 112 with a selection voltage corresponding to an H level as a scanning signal, the transistors 116 of the pixels 110 located on that line enter an on state (conductive state). At this time, as the X driver 140 supplies a data signal through a data line to the pixel located on the scanning line to which an H level scanning signal is applied, the data signal is applied through the data line 114 and the on-state transistor 116 to the pixel electrode 118. Thus, the liquid crystal capacitor 120 is written with a voltage difference between a voltage of the data signal and a voltage of the common signal supplied to the common electrode 521. After that, as the scanning line 112 attains a non-selection voltage corresponding to an L level, the transistors 116 enter an off state (non-conductive state); however, in each of the liquid crystal capacitors 120, the voltage written when the transistor 116 enters a conductive state is held by its capacitive characteristic and the storage capacitor 109.

Here, when a gray scale is performed in a typical analog method, a data signal is written to the liquid crystal capacitor 120 as a voltage corresponding to a gray scale; however, the analog method causes display chrominance nonuniformity due to a wiring resistance, or the like, or requires an additional D/A conversion circuit, or the like. Thus, the present embodiment employs a configuration such that the voltage of the data signal is either one of two values, that is, an on voltage that causes the liquid crystal capacitor 120 to enter an on state and an off voltage that causes the liquid crystal capacitor 120 to enter an off state. Note that the on voltage and the off voltage are respectively voltages that cause the liquid crystal capacitor 120 to enter a dark state and a bright state in a normally white mode when applied to the pixel electrode 118, and the detailed description will be described later.

In this way, in order to perform grayshade using binary voltages, it is only necessary to change the ratio of an on state (or off state) period within one field, which is a basic period, depending on a gray scale. Note that the one field is synonymous with a frame in an non-interlaced manner and is constant at 16.7 ms (which corresponds to one period of 60 Hz). In the present embodiment, the unit of a period during which an on state or an off state is set is a sub-field divided out from one field.

Figure 4:
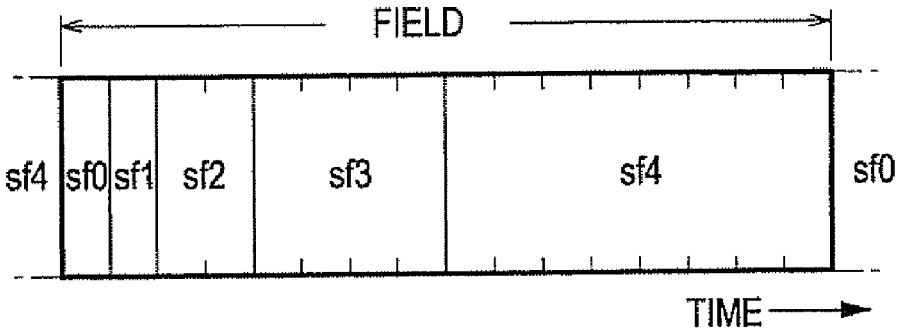
FIG. 4 is a view that shows the configuration of a field used in the liquid crystal device.

Next, the sub-fields in the present embodiment will be described. FIG. 4 is a view that conceptually shows the configuration of the sub-fields used in the liquid crystal device 1. Note that in the liquid crystal device 1, it is assumed that 16 gray-scale levels, that is, gray-scale levels of "0" to "15", are specified with 4-bit data for each pixel. In this case, as shown in the drawing, one field is formed of sub-fields sf0 to sf4. Here, the sub-fields sf0 to sf4 are set to divide the length of the one field into, for example, the ratio of 1:1:2:4:8 in period.

Next, how the on state or the off state is allocated to each of the sub-fields sf0 to sf4 for each gray-scale level specified with 4-bit data will be described. FIG. 5 is a table that shows the allocation, in which sub-fields to which the on state is allocated are represented as "on" and sub-fields to which the off state is allocated are represented as "off". As shown in the drawing, when the minimum gray-scale level "0" specifies black color, which is the darkest state, a brighter state is specified as the gray-scale level increases, and the maximum gray-scale level "15" specifies white color, which is the brightest state, the on or off state is specified in each of the sub-fields sf1 to sf4 in correspondence with the weight of 4 bits that specify each gray-scale level. Note that in the sub-field sf0 that is located at the leading end of one field, the off state is always specified irrespective of a gray-scale level.

Referring back to FIG. 1, the operation of the circuit units that constitute the liquid crystal device 1 will be described. In FIG. 1, the image processing circuit 20 performs various types of image processing, such as noise reduction process or ghost image removal process, for example, on image data Din supplied from an external upper level circuit (not shown) and then outputs the data as image data Da.

Here, the image data Din specify the gray scale of each of the pixels arranged in the display area 10*a* in 1080 rows by 1920 columns, and are supplied in synchronization with a synchronizing signal Sync (vertical scanning and horizontal scanning). On the other hand, in the present embodiment, as described above, the on/off state of each pixel in the display panel 10 is controlled by the sub-fields, and interlaced scanning is performed on the scanning lines by the Y driver 130 as will be described later. Thus, in the present embodiment, it is necessary to match the timing of the image data Din (processed image data Da), supplied from the external upper level circuit, with the drive timing of the display panel 10 again, convert the image data Da into data signals that cause the pixels to enter an on or off state and supply the resultant data signals.

The timing control circuit 30 defines a field, which is a drive reference period of the display panel 10, on the basis of a period during which one-frame image data Din are supplied, and controls the Y driver 130 and the X driver 140 so as to drive the pixels in the sub-fields sf0 to sf4 into which the above field is divided.

The data conversion circuit 40 schematically converts a gray-scale level specified by the image data Da for each pixel into data Dsf that specify the on/off state in each of the sub-fields sf0 to sf4. Thus, the data conversion circuit 40 includes a field memory 410 and a look up table (LUT) 420.

In the field memory 410, through control of the timing control circuit 30, at least one field image data Da are once stored and the stored image data Da are read out. The table having the contents shown in FIG. 5 is set in the LUT 420. The LUT 420 converts the image data Da, read out from the field memory 410, into data Dsf that specify on/off state in each sub-field sf0 to sf4 for the gray-scale level specified by the image data Da. Here, to convert the image data Da into the data Dsf, in addition to the image data Da, it is necessary to obtain information that indicates which sub-field the data Dsf corresponds to. Thus, the timing control circuit 30 supplies data Nsf, which indicate a sub-field number, to the LUT 420, and the LUT 420 outputs data Dsf corresponding to the gray scale specified by the image data Da read out from the field memory 410 and the sub-field indicated by the data Nsf.

The Y driver 130 supplies the first to 1080th scanning lines 112 with the respective scanning signals G1 to G1080 in accordance with the timing control circuit 30. Note that in the present embodiment, interlaced scanning is performed on the scanning lines in terms of suppressing the operation speed of the Y driver 130 and reducing a period of time in which the off state is maintained in the sub-field sf0.

Figure 6:
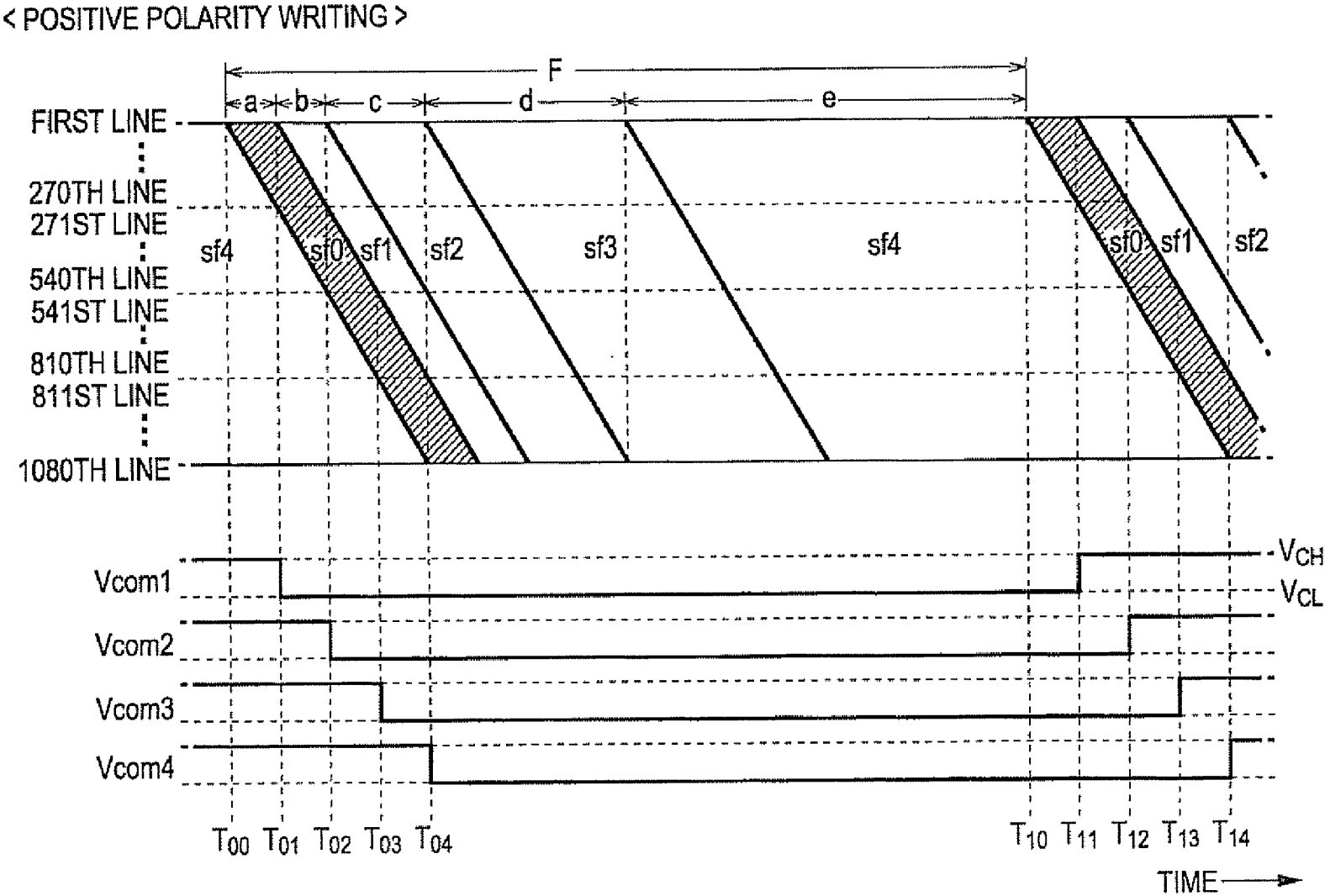
FIG. 6 is a view that illustrates the operation of the display panel of the liquid crystal device.
Figure 7:
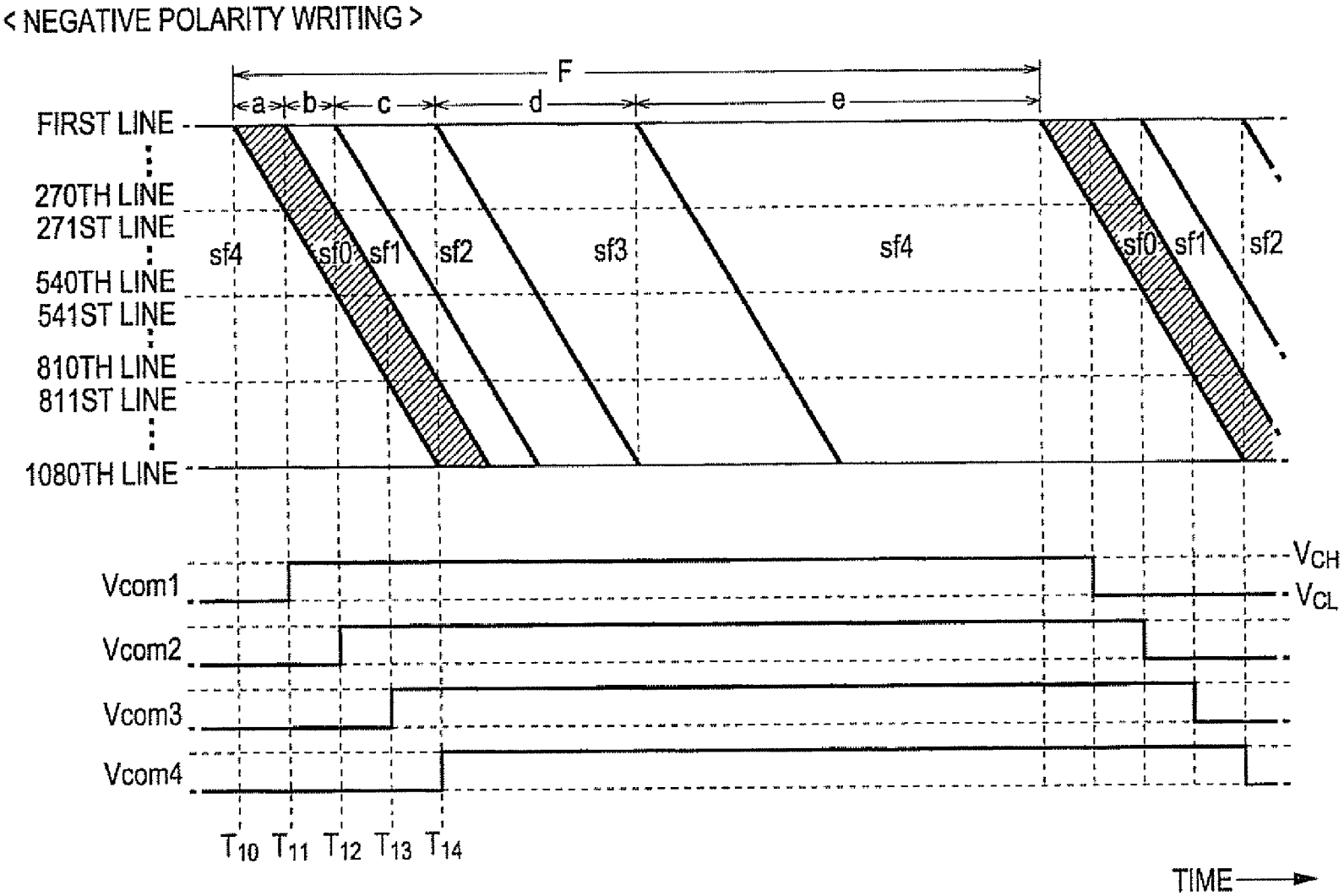
FIG. 7 is a view that illustrates the operation of the display panel of the liquid crystal device.

Next, how the writing to the first to 1080th row pixels, causing the pixels to enter the on or off state, progresses in one field will be described. FIG. 6 and FIG. 7 each are views that show a transition in writing to the first to 1080th rows together with the voltage waveforms of the common signals Vcom1 to Vcom4. FIG. 6 shows a transition in writing of a field in which positive polarity writing is performed. FIG. 7 shows a transition in writing of a field in which negative polarity writing is performed. Note that in FIG. 6 and FIG. 7, F represents the period of one field of the pixels located on the first scanning line, and the period F may be classified into periods a, b, c, d, and e so as to correspond to the sub-fields sf0 to sf4.

Here, the period a is a period from time when a selection voltage is applied to the first scanning line for the first time in order to perform writing in the sub-field sf0 on the pixels located on the first scanning line until time when a selection voltage is applied to the first scanning line for the second time in order to perform writing in the sub-field sf1. Similarly, the periods b, c and d are respectively periods from time when a selection voltage is applied to the first scanning line for the second, third and fourth time in order to perform writing on the pixels located on the first scanning line until time when a selection voltage is applied to the first scanning line for the third, fourth and fifth time in order to perform writing in the sub-fields sf2, sf3 and sf4. In addition, the period e is a period from time when a selection voltage is applied to the first scanning line for the fifth time in order to perform writing in the sub-field sf4 on the pixels located on the first scanning line until time when a selection voltage is applied to the first scanning line in order to perform writing in the next sub-field sf0.

Note that the writing that is performed by applying a selection voltage to the scanning line is executed exclusively to each line. Thus, in FIG. 6 or FIG. 7, the timing at which a selection voltage is applied to each of the scanning lines should be represented with small dots that do not overlap each other with respect to the time axis; however, in order to give priority to showing the temporal progress of writing in each line for easy understanding, the small dots are shown as continuous solid line. As is apparent from the solid line being inclined to the lower right side, the scanning line to which a selection voltage is applied in order to perform writing in each sub-field goes toward the lower side (first to 1080th lines) of the display panel 10 over time. Thus, with respect to the one field period F of the pixels located on the leading first scanning line, the fields and the sub-fields sf0 to sf4 for the second and following row pixels are sequentially shifted.

During the period a, the sequence of line numbers of the scanning lines 112 to which the Y driver 130 applies a selection voltage is as follows.

During the period a,
first ->
second ->
third ->
. . . ->
270th ->

That is, during the period a, the Y driver 130 sequentially selects the first to 1080th scanning lines, and applies a selection voltage to the selected scanning line.

Next, during the period b, the sequence of line numbers of the scanning lines 112 to which the Y driver 130 applies a selection voltage is as follows.

During the period b,
271st ->first ->
272nd ->second ->
273rd ->third ->
. . . -> . . . ->
540th ->270th ->

That is, during the period b, the Y driver 130 selects two scanning lines that are located 270 lines away from each other, sequentially applies a selection voltage to the selected two scanning lines, and then shifts one line to the two scanning lines that are selected in the next period.

Subsequently, during the period c, the sequence of line numbers of the scanning lines 112 to which the Y driver 130 applies a selection voltage is as follows.

During the period c,
541st ->271st ->first ->
542nd ->272nd ->second ->
543rd ->273rd ->third ->
. . . -> . . . -> . . . ->
1080th ->810th ->540th ->

That is, during the period c, the Y driver 130 selects three scanning lines that are located 270 lines away from each other, sequentially applies a selection voltage to the selected three scanning lines, and then shifts one line to the three scanning lines that are selected in the next period.

During the period d, the sequence of line numbers of the scanning lines 112 to which the Y driver 130 applies a selection voltage is as follows.

During the period d,
811th ->541st ->first ->
812th ->542nd ->second ->
813th ->543rd ->third ->
. . . -> . . . -> . . . ->
1080th ->810th ->270th ->
811th ->271st ->
812th ->272nd ->
813th ->273rd ->
810th ->270th ->
. . . -> . . . ->
1080th ->540th ->
541st ->
542nd ->
543rd ->
. . . ->
1080th ->

That is, the period d is further divided into first to third periods. During the first period, the Y driver 130 selects three scanning liens that are sequentially located 270 lines and 540 lines away from each other, sequentially applies a selection voltage to the selected three scanning lines and then shifts one line to the three scanning lines that are selected in the next period. During the second period, the Y driver 130 selects two scanning lines that are located 540 lines away from each other, sequentially applies a selection voltage to the selected two scanning lines and then shifts one line to two scanning lines that are selected in the next period. During the third period, the Y driver 130 sequentially selects the 541st to 1080th scanning lines and applies a selection voltage to the selected scanning line.

Then, during the period e, the sequence of line numbers of the scanning lines 112 to which the Y driver 130 applies a selection voltage is as follows.

During the period e,
first ->
second ->
third ->
. . . ->
1080th

That is, during the period e, the Y driver 130 sequentially selects the first to 1080th scanning lines, and applies a selection voltage to the selected scanning line.

On the other hand, the X driver 140 converts the data Dsf, which are converted by the LUT 420 and correspond to the first to 1920th column pixels, into an on voltage when the data Dsf indicate an on state or into an off voltage when the data Dsf indicate an off state, and supplies the on/off voltages to the first to 1920th data lines 114 as the data signals d1 to d1920 in accordance with control of the timing control circuit 30 in synchronization with the timing at which the scanning signal of that line attains an H level.

Here, to place a pixel in an off state, it is only necessary to set a voltage, which is applied to the pixel electrode 118 when the transistor 116 enters an on state, to be lower than or equal to an optical threshold voltage that, for example, gives a relative transmittance ratio of 10%. Thus, in the present embodiment, the voltage of the common signal at that time is used as an off voltage for the pixel. On the other hand, to place a pixel in an on state, it is only necessary to set a voltage, which is applied to the pixel electrode 118 when the transistor 116 enters an on state, to be higher than or equal to an optical saturation voltage that, for example, gives a relative transmittance ratio of 90%. Thus, in the present embodiment, a voltage that is inverted from the voltage of the common signal at that time is used as an on voltage for the pixel.

The common signal supply circuit 50, in accordance with control of the timing control circuit 30, switches the voltages of the common signals Vcom1 to Vcom4 as follows in association with the progress of timing at which a selection voltage is applied to the scanning line. That is, as shown in FIG. 6, the common signal supply circuit 50 switches the common signal Vcom1 from the voltage $V_{CH}$ to the voltage $V_{CL}$ at the timing $T_{01}$, at which application of a selection voltage to the 270th scanning line ends, in order to write an off voltage in the sub-field sf0 in the period F during which positive polarity writing is performed. Similarly, in order to write an off voltage in the sub-field sf0, the common signal supply circuit 50 switches the common signal Vcom2 from the voltage $V_{CH}$ to the voltage $V_{CL}$ at the timing $T_{02}$ at which application of a selection voltage to the 540th scanning line ends, switches the common signal Vcom3 from the voltage $V_{CH}$ to the voltage $V_{CL}$ at the timing $T_{03}$ at which application of a selection signal to the 810th scanning line ends, and switches the common signal Vcom4 from the voltage $V_{CH}$ to the voltage $V_{CL}$ at the timing $T_{04}$ at which application of a selection voltage to the 1080th scanning line ends. Note that in the period F during which negative polarity wiring is performed, as shown in FIG. 7, the common signal supply circuit 50 switches the voltages of the common signals Vcom1 to Vcom4 in the reverse direction to the period F during which positive polarity writing is performed.

1-2: Operation of Liquid Crystal Device

Next, the operation of the liquid crystal device 1 will be described. The image processing circuit 20 performs image processing on image data Din supplied from the external upper level circuit and outputs the processed image data Din as image data Da. The image data Da are stored in the field memory 410 by the timing control circuit 30 and are read out in synchronization with the operation of the display panel 10.

First, the case in which positive polarity writing is performed will be described with reference to FIG. 6. During the period a, writing in the sub-field sf0 to the first row pixels is performed. When the scanning signal G1 supplied to the first scanning line attains an H level, the transistors 116 in the first row pixels 110 enter an on state. On the other hand, during the period a, before the scanning signal G1 supplied to the first scanning line attains an H level, image data Da corresponding to the first row and the first to 1920th column pixels are read out from the field memory 410 and supplied to the LUT 420. However, as shown in FIG. 5, because it should be placed in an off state in the sub-field sf0 irrespective of gray-scale levels specified by the image data Da, the image data Da corresponding to the first row and the first to 1920th column pixels all are converted into data Dsf that specify that all the pixels are placed in an off state and then supplied to the X driver 140. Then, when the scanning signal G1 attains an H level, the X driver 140 converts all pieces of supplied data Dsf corresponding to the first to 1920th columns into an off voltage again and supplies them to the first to 1920th data lines 114 as the data signals d1 to d1920. In this way, because the pixel electrodes 118 in the first row pixels 110 are applied with the same voltage as the first group common electrode 521*a* through the data lines 114 and the on state transistors 116, the first row pixels 110 enter an off state. Note that at the start timing $T_{00}$ of the period F (period a), the common signal Vcom1 corresponding to the first to 270th lines is a voltage $V_{CH}$, which is an off voltage of the first to 270th lines.

During the period a, writing in the sub-field sf0 to the second row pixels is performed next. As the scanning signal G2 supplied to the second scanning line attains an H level, the scanning signal G1 attains an L level. Thus, the transistors 116 in the first row pixels 110 enter an off state to maintain an off state, while the transistors 116 in the second row pixels 110 enter an on state to write an off voltage therein. Thus, the second row pixels 110 also enter an off state. During the period a, the similar operation will be executed up to the 270th line. By so doing, the first to 270th row pixels 110 all enter an off state.

During the period b, a selection voltage is applied to the scanning lines through interlaced scanning in the sequence of 271st ->first ->272nd ->second -> . . . ->. . . ->540th ->270th lines. Of these, application of a selection voltage to the 271st to 540th scanning lines is performed for writing in the sub-field sf0. Thus, during the period b, the 271st to 540th row pixels 110 all enter an off state as in the case of the first to 270th row pixels during the period a.

On the other hand, application of a selection voltage to the first to 270th scanning lines during the period b is performed for writing in the sub-field sf1. Before the scanning signal G1 attains an H level in the period b, image data Da corresponding to the first row and the first to 1920th column pixels are read out from the field memory 410. In accordance with the conversion contents of the LUT 420 shown in FIG. 5, the read image data Da are converted into data Dsf that define an on/off state on the basis of the gray-scale levels specified by the image data Da in the sub-field sf1 and supplied to the X driver 140. The X driver 140, when the scanning signal G1 attains an H level, converts the data Dsf corresponding to the supplied first to 1920th columns into on/off voltages and outputs them as the data signals d1 to d1920. In this way, during the period b, the first row pixels 110 each enter an on state or an off state on the basis of the sub-field sf1 and the gray-scale level. During the period b, the second to 270th row pixels 110, as well as the first row pixels, each enter an on state or an off state on the basis of the sub-field sf1 and the gray-scale level. Note that because the common signal Vcom1 switches from the voltage $V_{CH}$ to the voltage $V_{CL}$ at the start timing $T_{01}$ of the period b, during the period b and later, the on voltage for the first to 270th row pixels is $V_{CH}$ and the off voltage therefor is $V_{CL}$.

During the period c, a selection voltage is applied to the scanning lines through interlaced scanning in the sequence of 541st ->271st ->first ->542nd ->272nd ->second ->543rd ->273rd ->third -> . . . -> . . . -> . . . ->1080th ->810th ->540th lines. Of these, the off voltage is written for the sub-field sf0 by applying a selection voltage to the 541st to 1080th scanning lines that are selected in the first, fourth, seventh, . . . , and 1618th places, and thereby the corresponding pixels 110 enter an off state. Note that during a period from the timing $T_{02}$ to the timing $T_{03}$ within the period c, the common signal Vcom3 corresponding to the 541st to 810th lines is the voltage $V_{CH}$, so that the voltage $V_{CH}$ is the off voltage for the 541st to 810th pixels 110 in that period. Similarly, during a period from the timing $T_{03}$ to the timing $T_{04}$ within the period c, the common signal Vcom4 corresponding to the 811th to 1080th lines is the voltage $V_{CH}$, so that the voltage $V_{CH}$ is the off voltage for the 811th to 1080th row pixels 110 in that period.

Within the period c, by applying a selection voltage to the 271st to 810th scanning lines that are selected in the second, fifth, eighth, . . . , and 1619th places, the on state or the off state is written for the sub-field sf1 on the basis of the gray-scale level. Thus, the corresponding pixels 110 enter an on state or an off state on the basis of the sub-field sf1 and the gray-scale level. Note that because the common signal Vcom2 switches to the voltage $V_{CL}$ at the timing $T_{02}$ in the period c, at the timing $T_{02}$ and later, the on voltage for the 271st to 540th row pixels is $V_{CH}$ and the off voltage therefor is $V_{CL}$. In addition, because the common signal Vcom3 switches to the voltage $V_{CL}$ at the timing $T_{03}$ in the period c, at the timing $T_{03}$ and later, the on voltage for the 541st to 810th row pixels is $V_{CH}$ and the off voltage therefor is $V_{CL}$.

Within the period c, by applying a selection voltage to the first to 540th scanning lines that are selected in the third, sixth, ninth, . . . , and 1620th places, the on state or the off state is written for the sub-field sf2 on the basis of the gray-scale level. Thus, the corresponding pixels 110 enter an on state or an off state on the basis of the sub-field sf2 and the gray-scale level.

Next, the period d will be described by dividing the period d into three periods as follows.

That is, the period d will be described by being divided into a first period during which a selection voltage is applied to the scanning lines through interlaced scanning in the sequence of 811th ->541st ->first ->812th ->542nd ->second ->813th ->543rd ->third -> . . . -> . . . -> . . . ->1080th ->810th ->270th lines, a second period during which a selection voltage is applied to the scanning lines through interlaced scanning in the sequence of 811th ->271st ->812th ->272nd -> . . . -> . . . ->1080th ->540th, and a third period during which a selection voltage is applied to the scanning lines through non-interlaced scanning in the sequence of 541st ->542nd -> . . . ->1080th lines.

During the first period, the on or off voltage based on the sub-field sf1 and the gray-scale level is written by applying a selection voltage to the 811th to 1080th scanning lines. By so doing, the corresponding pixels 110 enter an on state or an off state depending on a voltage written. Note that because the common signal Vcom4 switches to the voltage $V_{CL}$ at the timing $T_{04}$ in the period d, at the timing $T_{04}$ and later, the on voltage for the 811th to 1080th row pixels is $V_{CH}$ and the off voltage therefor is $V_{CL}$. In addition, during the first period, the on or off voltage based on the sub-field sf2 and the gray-scale level is written by applying a selection voltage to the 541st to 810th scanning lines, and furthermore, the on or off voltage based on the sub-field sf3 and the gray-scale level is written by applying a selection voltage to the first to 270th scanning lines. In this way, the corresponding pixels 110 are placed in a state corresponding to a written voltage.

Next, during the second period, the on or off voltage based on the sub-field sf2 and the gray-scale level is written by applying a selection voltage to the 811th to 1080th scanning lines, and furthermore, the on or off voltage based on the sub-field sf3 and the gray-scale level is written by applying a selection voltage to the 271st to 540th scanning lines. In this way, the corresponding pixels 110 are placed in a state corresponding to a written voltage.

Then, during the third period, the on or off voltage based on the sub-field sf3 and the gray-scale level is written by applying a selection voltage to the 541th to 1080th scanning lines. In this way, the corresponding pixels 110 are placed in a state corresponding to a written voltage.

During the period e, the on or off voltage based on the sub-field sf4 and the gray-scale level is written by applying a selection voltage to the scanning lines in the sequence of first ->second ->third -> . . . ->1080th lines. In this way, the corresponding pixels 110 are placed in a state corresponding to a written voltage.

Thus, from the period a to the period e, the scanning lines are applied with a selection signal in accordance with the sub-fields sf0 to sf4. Of these, through the writing of the on or off voltage in the sub-fields sf1 to sf4, when the period of one field is regarded as a unit, a period during which each pixel is in an on state is lengthened as the gray-scale level specifies a darker state. By so doing, the gray scale is performed.

Note that in the field following the field in which positive polarity writing is executed, negative polarity writing is executed in order to prevent a direct current component from being applied to the liquid crystal 105. More specifically, as shown in FIG. 7, in the negative polarity writing field, the timing at which a selection voltage is applied in the sub-fields sf0 to sf4 is the same as the positive polarity writing field, and the voltages of the common signals Vcom1 to Vcom4 are inverted. Here, when a selection voltage is applied to the scanning lines for the sub-fields sf1 to sf4 when negative polarity writing is performed, because the common signals Vcom1 to Vcom4 are at the voltage $V_{CH}$ and, therefore, the on voltage is $V_{CL}$ and the off voltage is $V_{CH}$.

Figure 8:
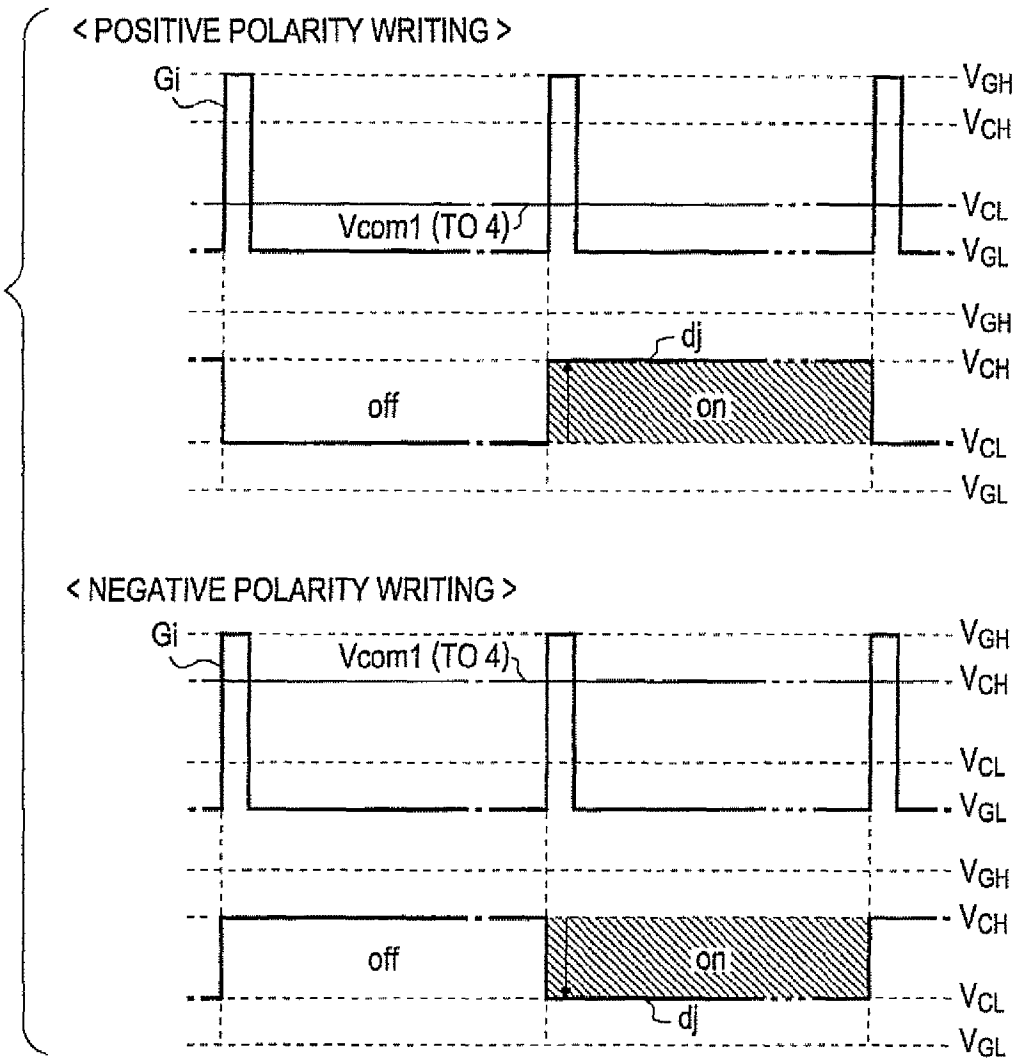
FIG. 8 is a view that shows a transition in writing to the display panel of the liquid crystal device.

Next, the relationship in voltage among the scanning signal, data signal and common signal will be described with reference to FIG. 8. FIG. 8 is a view that shows the relationship in voltage between the scanning signal Gi supplied to the ith scanning line or the data signal dj supplied to the jth data line and the common signal. Note that in FIG. 8, the scale of the ordinate axis that represents a voltage is enlarged as compared with the scale of the ordinate axis of FIG. 6 or FIG. 7 for the sake of convenience.

When a positive polarity voltage is written to the ith row and jth column pixel, the common signal attains a low level side voltage $V_{CL}$. In this case, when the pixel is caused to enter an off state, the data signal dj attains the voltage $V_{CL}$ that is the same as the common signal when the scanning signal Gi attains a selection voltage VGH corresponding to an H level. When the pixel is caused to enter an on state, the data signal dj attains the voltage $V_{CH}$ that is obtained by inverting the common signal when the scanning signal Gi attains an H level. On the other hand, when a negative polarity voltage is written to the ith row and jth column pixel, the common signal attains a high level side voltage $V_{CH}$. In this case, when the pixel is caused to enter an off state, the data signal dj attains the voltage $V_{CH}$ that is the same as the common signal when the scanning signal Gi attains an H level, while when the pixel is caused to enter an on state, the data signal dj attains the voltage $V_{CL}$ that is obtained by inverting the common signal when the scanning signal Gi attains an H level.

In the present embodiment, the common electrodes are divided into four groups corresponding to the first to 270th lines, the 271st to 540th lines, the 541st to 810th lines and the 811th to 1080th lines, and in the sub-field sf0, at the time when all the scanning lines of the corresponding group have been applied with a selection voltage and the off voltage has been written, the voltage of the common electrodes of that group is inverted. In the present embodiment, the reason why the common electrode is alternately switched between binary values, that is, the low level side voltage $V_{CL}$ and the high level side voltage $V_{CH}$, is to reduce the withstanding voltage of the X driver 140. That is, if the voltage of the common electrode is configured to be constant, and a voltage difference between the on voltage and the voltage of the common electrode is represented as ΔVon, the range from the low level side on voltage to the high level side on voltage is 2ΔVon. This requires a design such that the X driver 140 withstands the voltage range 2ΔVon. Then, as in the present embodiment, when a positive polarity on voltage is applied to the pixel electrode 118, the common electrode is set to the low level side voltage $V_{CL}$, while when a negative polarity on voltage is applied to the pixel electrode 118, the common electrode is set to the high level side voltage $V_{CH}$. In this way, because the range from the positive polarity on voltage to the negative polarity on voltage is suppressed to ΔVon, the withstanding voltage of the X driver 140 is reduced to half.

Next, in order to perform grayshade using only binary values, that is, an on voltage and an off voltage, one field, which is a basic period, needs to be divided into sub-fields, and the ratio of a period during which the on voltage (or the off voltage) is applied needs to be changed by sub-fields on the basis of a gray scale. Here, in a case where grayshade is performed by applying the on voltage or the off voltage to the liquid crystal capacitors 120 (pixel electrodes 118) in each sub-field, if the common electrode is not divided so as to correspond to the groups and is common to all the pixels 110, there is inconvenience as follows. That is, in a case where the voltage of the common electrode is set to the low level side in a certain field, when the liquid crystal capacitors are caused to enter an on state in the last sub-field of that field, a positive polarity on voltage, which is higher than the voltage of the common electrode, is applied to the pixel electrodes. As the voltage of the common electrode is switched from the low level side to the high level side, the pixel electrodes in a high impedance state raise the voltage of the common electrode, which is at a high level side voltage, toward the high level side by the amount corresponding to the on voltage. In this state, when it is required to apply the low level side on voltage, it is necessary to apply a voltage, which is lower in level by a voltage difference corresponding to 2ΔVon from the raised voltage, to the pixel electrodes. This exerts a load on the X driver, which is against an intended purpose of switching the voltage of the common electrode. Note that in the description, the case in which the voltage of the common electrode is set to the low level side in a certain field and the voltage of the common electrode is switched to the high level side in the next field is exemplified; it is also applicable that the voltage of the common electrode is set to the high level side in a certain field and the voltage of the common electrode is switched to the low level side in the next field.

Figure 9:
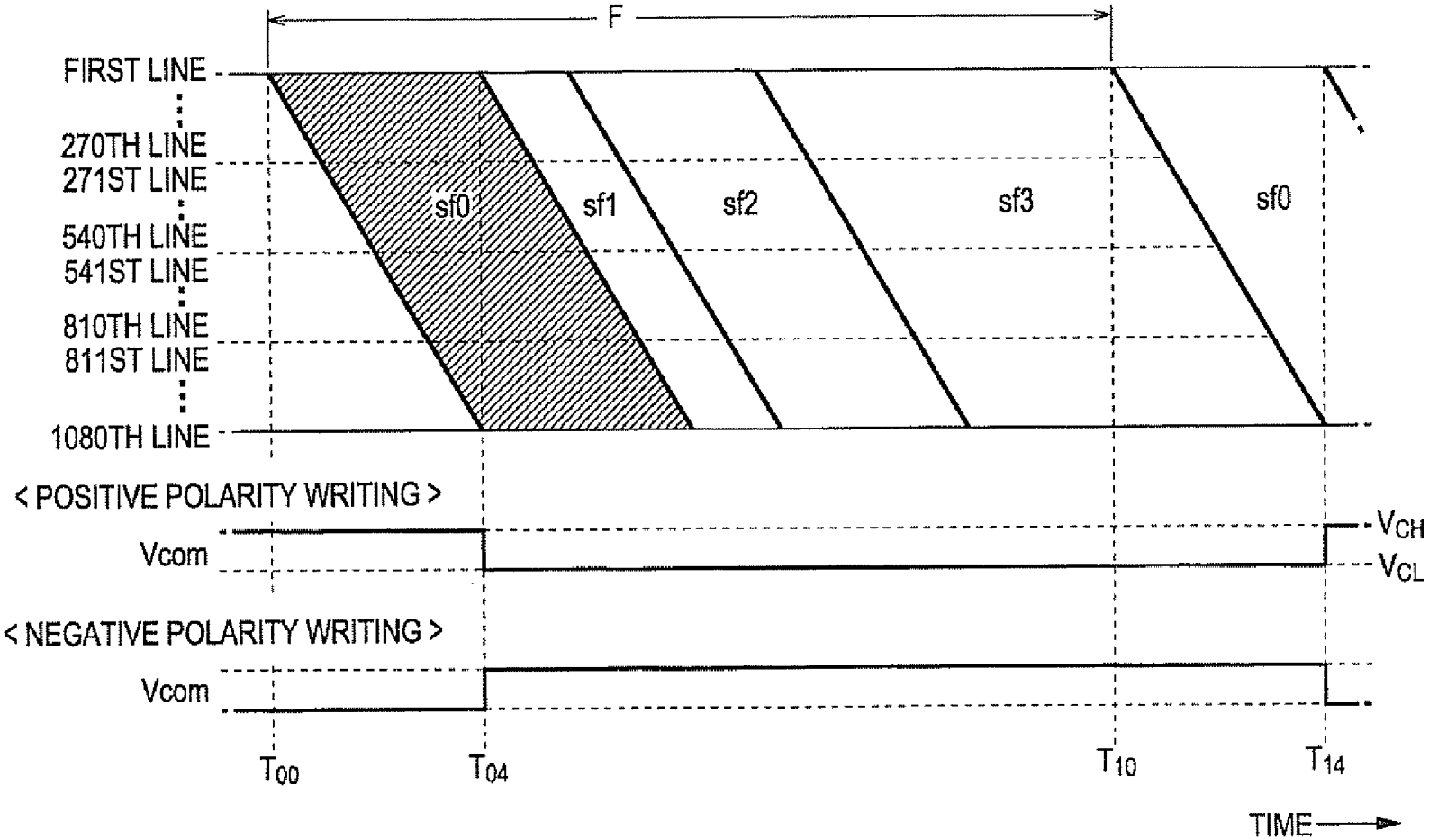
FIG. 9 is a view that shows a problem when the common electrode is common to all the pixels.

Then, in order to reduce the above load, it is necessary to once cause the pixels to enter an off state by applying the off voltage to the pixel electrodes before switching the voltage of the common electrode, and then switch the voltage of the common signal. Here, when the common electrode is common to all the pixels, as shown in FIG. 9, the off voltage is applied to the pixel electrodes by sequentially selecting the first to 1080th scanning lines over the period from the timing $T_{00}$ to the timing $T_{04}$, and when all the pixels enter an off state at the timing $T_{04}$, the voltage of the common electrode is switched. However, in the above configuration, the ratio of the period of the sub-field sf0 (period hatched in the drawing), during which all pixels are caused to enter an off state irrespective of the gray-scale level, to one field is large. The off state corresponds to a white, bright state when it is normally white mode. Thus, as the ratio of the period during which the pixels are in an off state increases, the minimum gray-scale black tends to appear poor display to thereby decrease the contrast ratio and, in addition, shortens the period during which the on or off voltage can be applied on the basis of a gray scale, thus causing a problem that the number of addressable luminance levels that can be displayed is reduced.

In contrast, in the present embodiment, the common electrodes are divided into four groups and the voltage of the common electrode of each group is inverted just after all the scanning lines of the corresponding group have been applied with a selection voltage and the off voltage has been written. Thus, according to the present embodiment, because the withstanding voltage of the X driver 140 is reduced by alternately switching the voltage, which is applied to the common electrode, between $V_{CL}$ and $V_{CH}$ and in addition the ratio of the sub-field sf0, during which each pixel is placed in an off state irrespective of the gray-scale level, to one field is reduced, it is possible to prevent a deterioration in contrast ratio and a decrease in the number of addressable luminance levels that can be displayed.

In addition, in the present embodiment, the common electrode is divided in correspondence with four groups, and the timing at which the voltage of the common electrode of each group is switched is sequentially shifted. Thus, in comparison with the configuration that the common electrode is not divided, the amount of charge/discharge required for voltage switching is reduced to thereby make it possible to switch the voltage for a further short period of time.

In the present embodiment, the number of groups into which the common electrode is divided is four; it may be two or more, instead. However, in a certain group, writing in the sub-field sf1 and the following sub-fields is processed by switching the voltage at the timing at which all the scanning lines belonging to the group are applied with a selection voltage in order to write the off voltage in the sub-field sf0, while in the remaining groups, in terms of processing writing of the off voltage in the sub-field sf0, it is necessary to perform interlaced scanning on the scanning lines.

Here, as the number of groups, that is, the number of divisions, is small, it is less effective to shorten the period of a specific sub-field, while as the number of groups is large, it is more effective to shorten the period of a specific sub-field. However, not only the configuration of the common signal supply circuit 50, but also the configuration of the display panel 10 by itself becomes complex because the number of conductive materials (which will be described in detail later) that connect the divided common electrodes and the capacitor lines increases. Thus, the number of divided groups should be determined through comparison between the above two points.

Note that in the embodiment, the transmittance ratio characteristic of each liquid crystal capacitor 120 is normally white mode; instead, it may be set to a normally black mode in which when the effective voltage value held in each liquid crystal capacitor 120 is approximate to zero, the transmittance ratio is minimal to perform black display, while as the effective voltage value increases, the amount of light transmitted increases and, as a result, white display having the maximal transmittance ratio is performed.

In addition, the ratio of the periods, sequence, and number of the sub-fields shown in FIG. 4 in the embodiment are just an example. For example, the specific sub-field sf0 during which the pixels are placed in an off state irrespective of the gray-scale levels may be located between the sub-fields sf1 to sf4. In addition, the mode of interlaced scanning shown in FIG. 6 (FIG. 7) is also just an example.

Furthermore, color display may be performed in such a manner that one dot is formed of three pixels of R (red), G (green) and B (blue). In addition, the liquid crystal device is not limited to a transmissive type but it may be of a reflective type or a transflective type which is intermediate between the transmissive type and the reflective type.

2: Mechanical Configuration of Liquid Crystal Device

Next, in the liquid crystal device 1, the mechanical configuration of the display panel 10 will be specifically described. Note that, as described above, it is applicable that the number of divided groups of the common electrode is two or more; the following opposite substrate and manufacturing process will be described under the situation that the number of divided groups is four.

Figure 10:
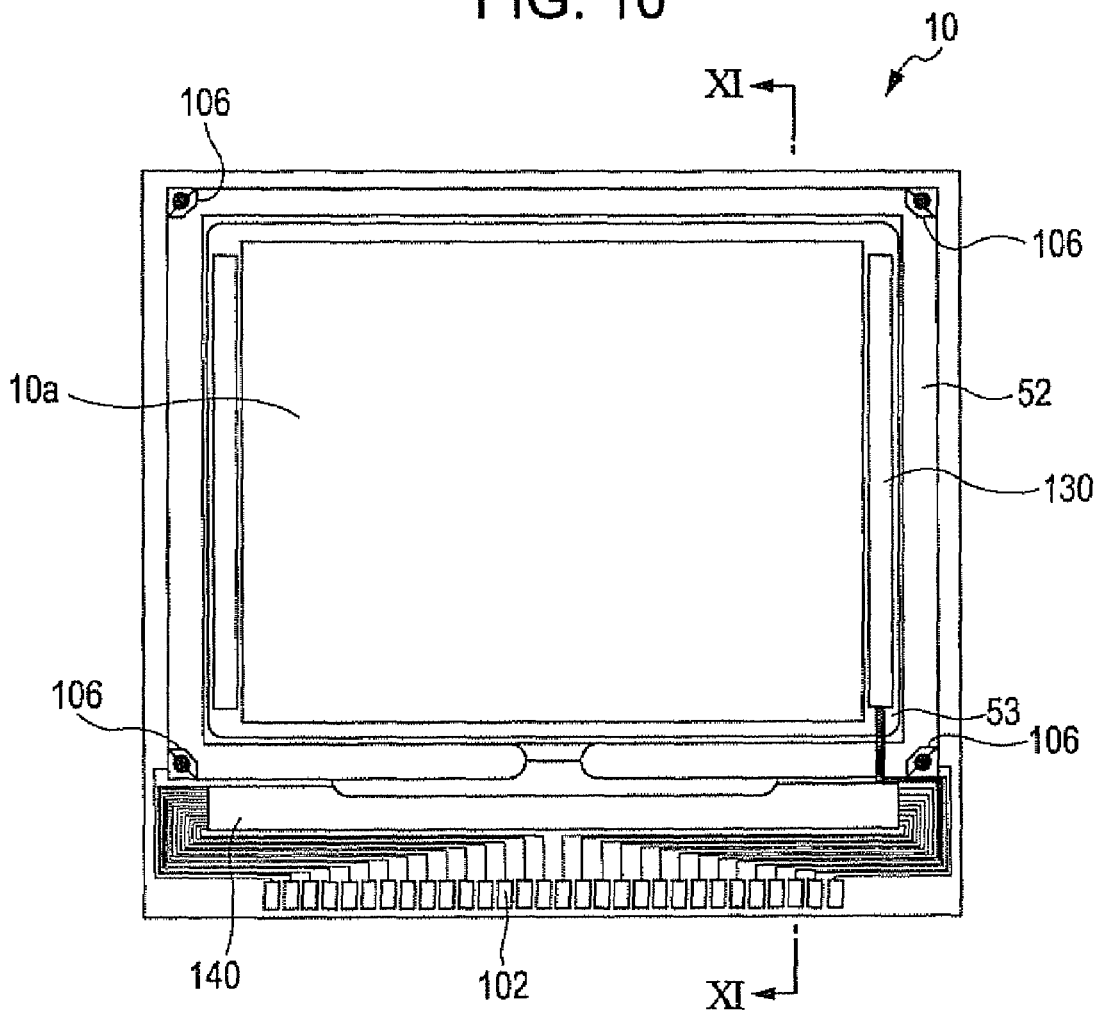
FIG. 10 is a plan view that shows the mechanical configuration of the display panel.
Figure 11:
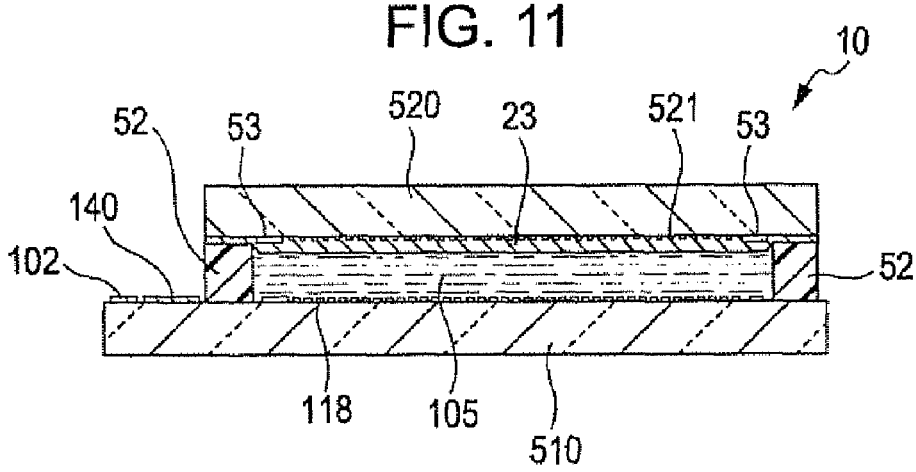
FIG. 11 is a cross-sectional view that is taken along the line XI-XI in FIG. 10.
Figure 12:
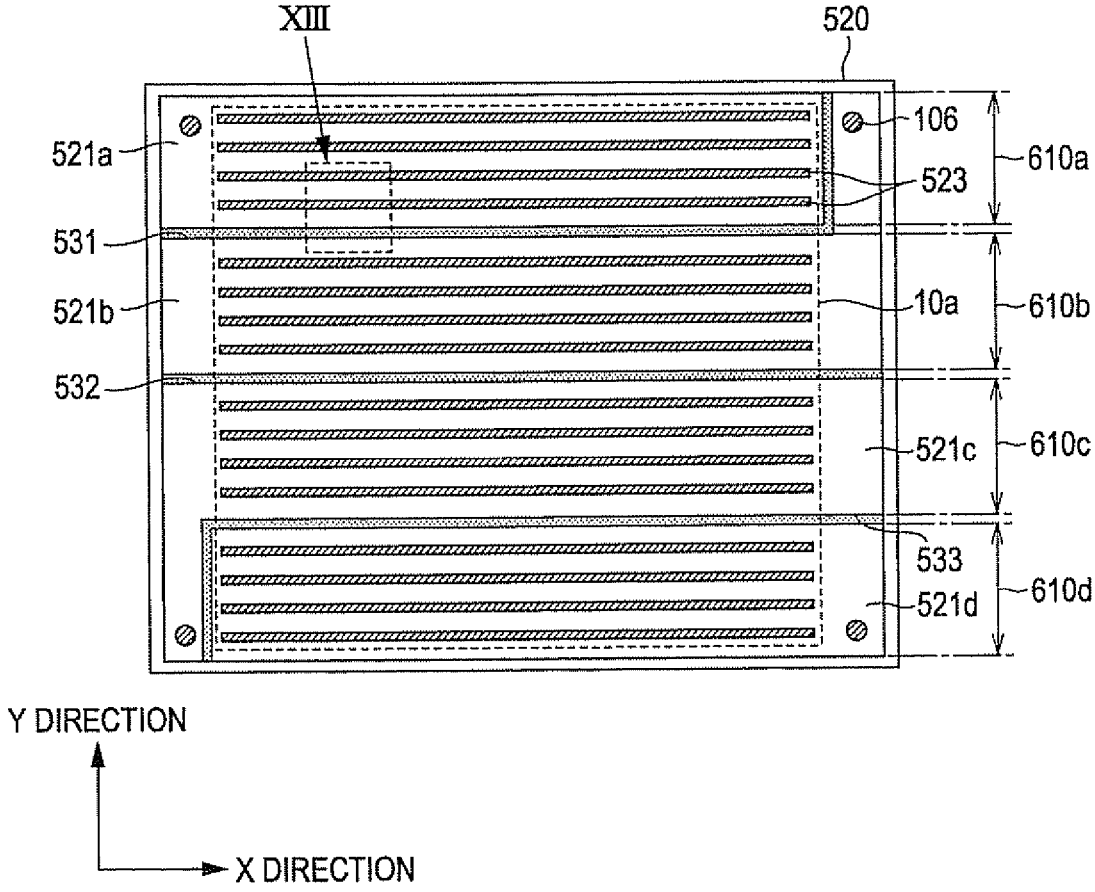
FIG. 12 is a plan view that shows the configuration of the common electrodes of the display panel.
Figure 13:
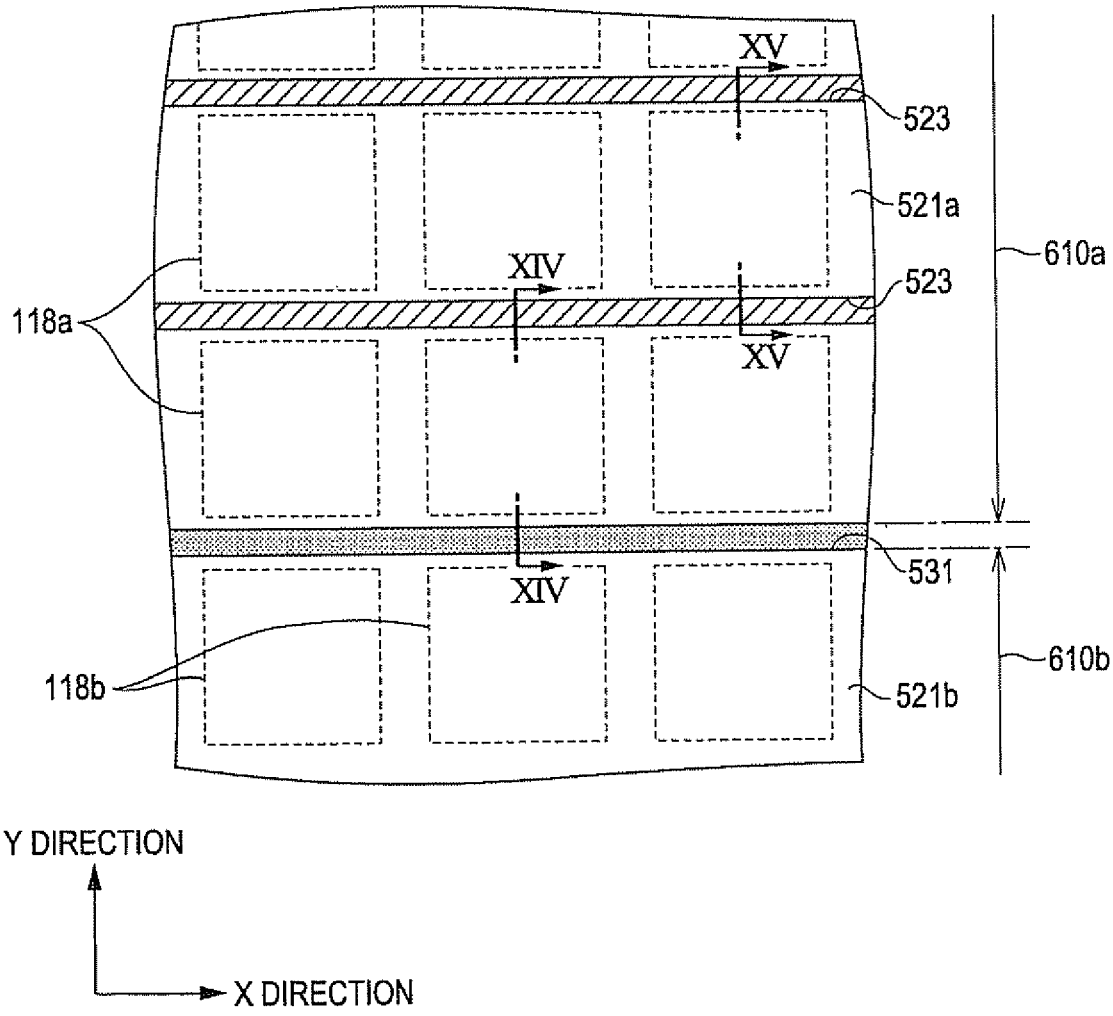
FIG. 13 is a partial plan view of the display panel.
Figure 14:
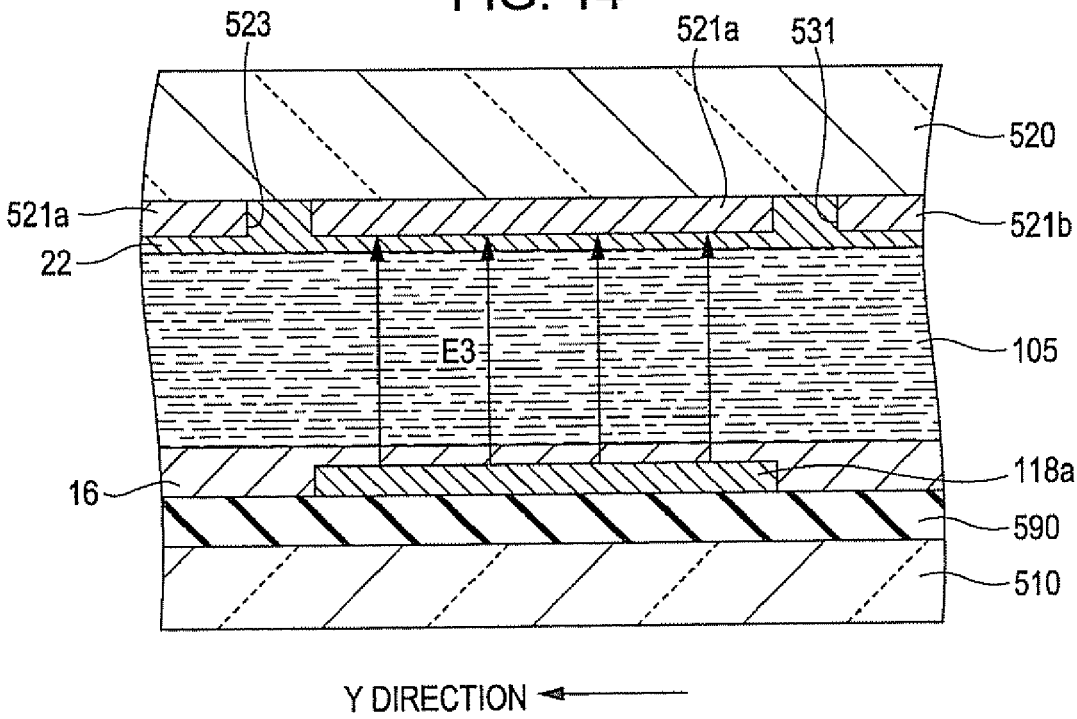
FIG. 14 is a cross-sectional view that is taken along the line XIV-XIV in FIG. 13.
Figure 15:
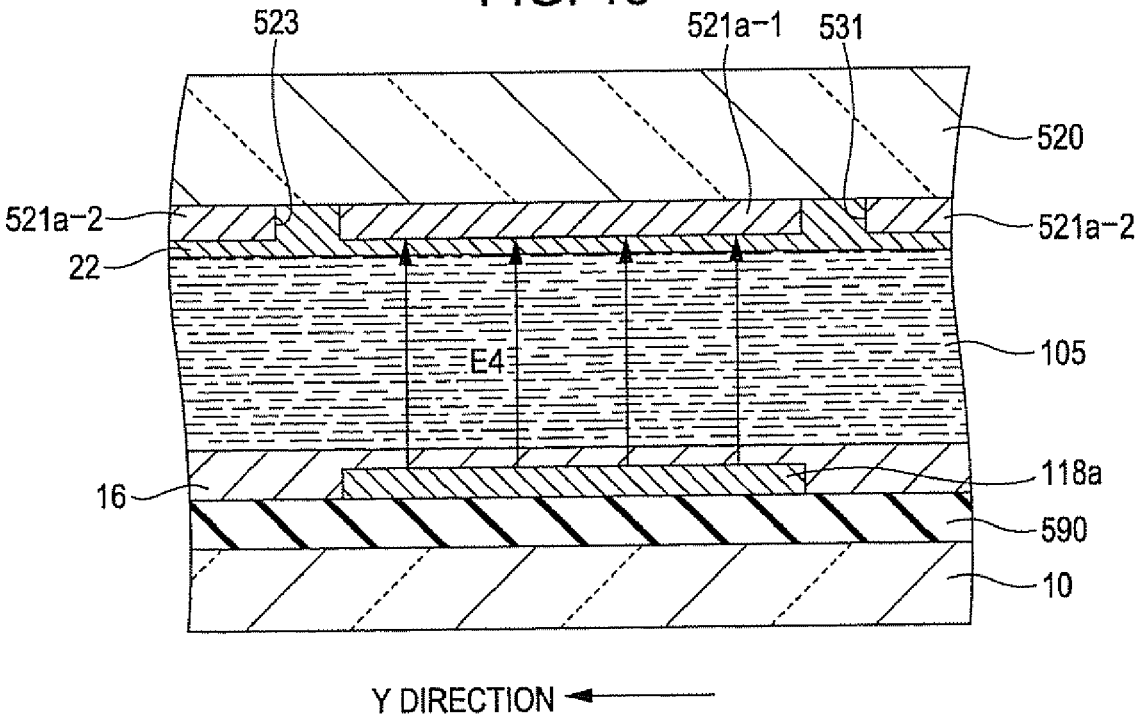
FIG. 15 is a cross-sectional view that is taken along the line XV-XV in FIG. 13.
Figure 16:
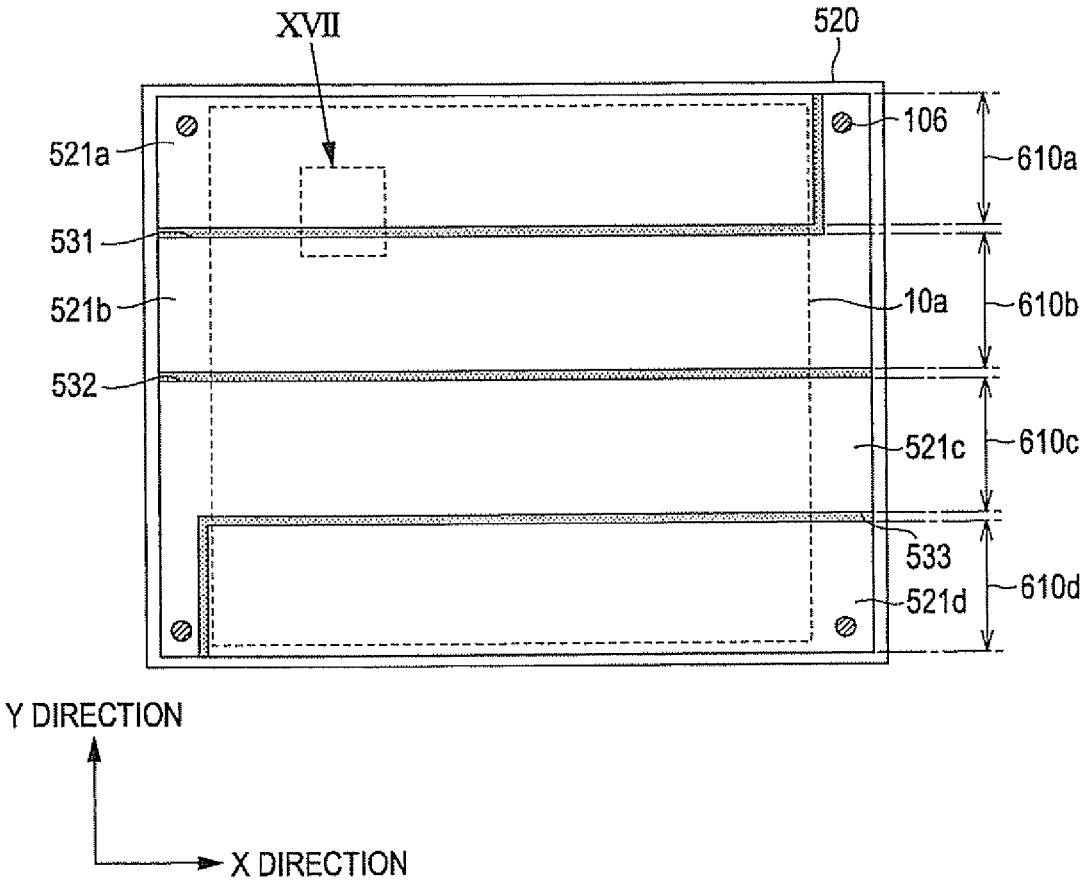
FIG. 16 is a plan view that shows the common electrodes of the display panel of the liquid crystal device according to a comparative example.
Figure 17:
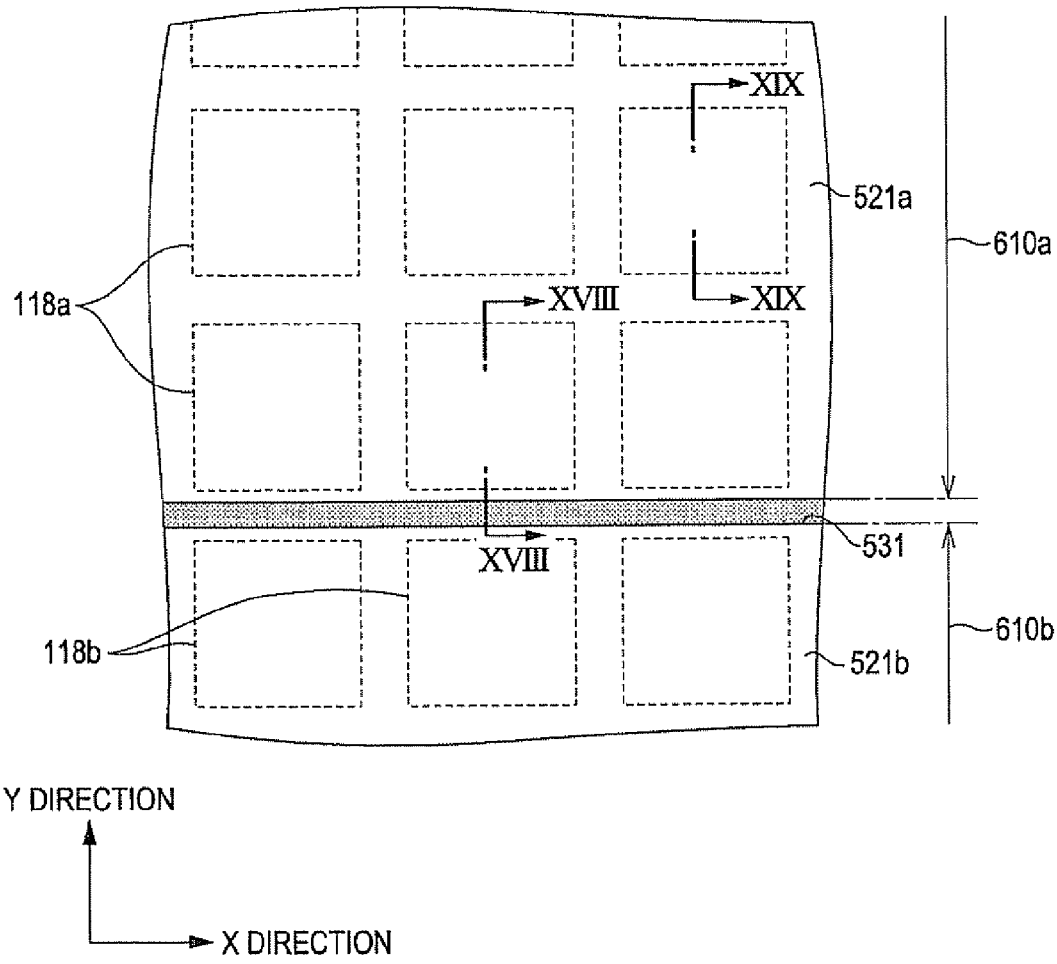
FIG. 17 is a partial plan view of the display panel according to the comparative example.
Figure 18:
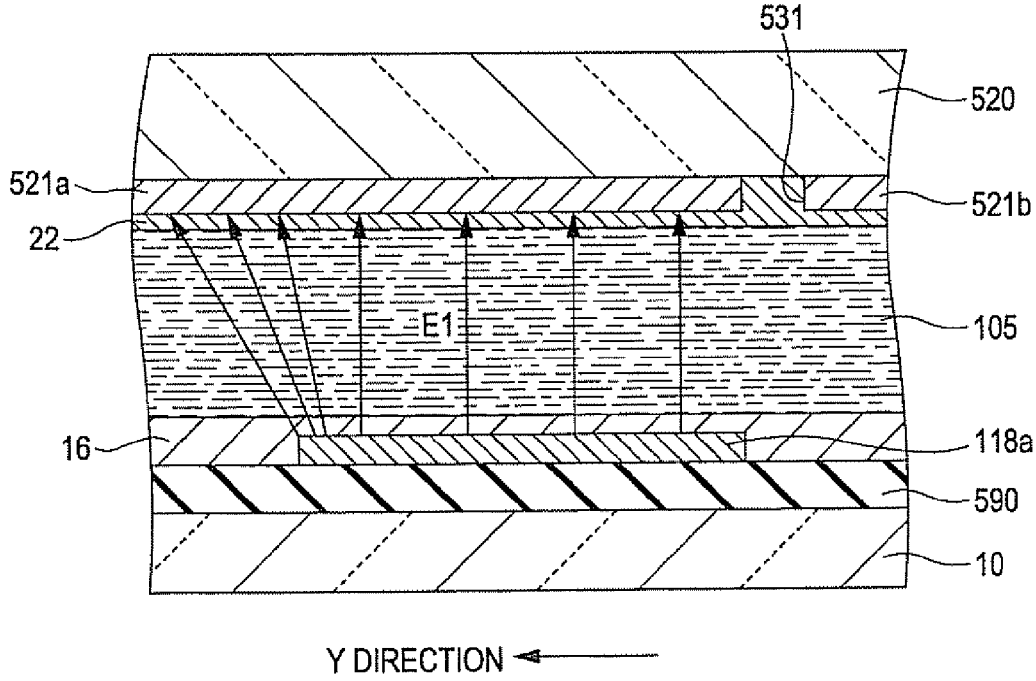
FIG. 18 is a cross-sectional view that is taken along the line XVIII-XVIII in FIG. 17.
Figure 19:
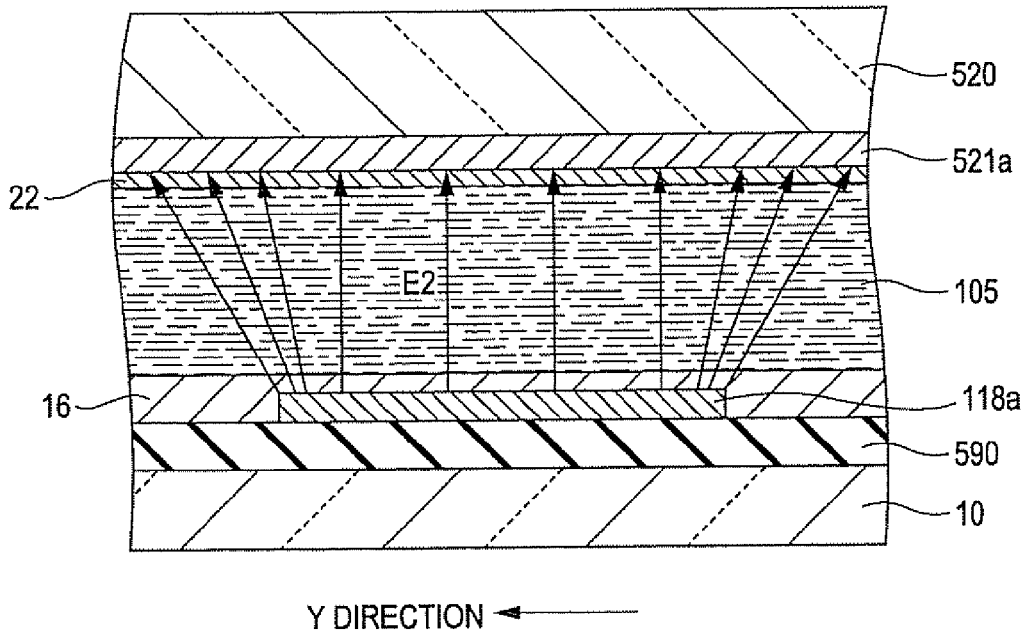
FIG. 19 is a cross-sectional view that is taken along the line XIX-XIX in FIG. 17.

FIG. 10 is a plan view that shows the mechanical general configuration of the display panel 10. FIG. 11 is a cross-sectional view that is taken along the line XI-XI in FIG. 10. FIG. 12 is a plan view that shows the general configuration of the common electrodes of the display panel 10 in the liquid crystal device according to the present embodiment. FIG. 13 is a partial plan view of the display panel 10. FIG. 14 is a cross-sectional view that is taken along the line XIV-XIV in FIG. 13. FIG. 15 is a cross-sectional view that is taken along the line XV-XV in FIG. 13. FIG. 16 is a plan view that shows the general configuration of the common electrodes of a display panel according to a comparative example. FIG. 17 is a partial plan view of the display panel according to the comparative example. FIG. 18 is a cross-sectional view that is taken along the line XVIII-XVIII in FIG. 17. FIG. 19 is a cross-sectional view that is taken along the line XIX-XIX in FIG. 17.

As shown in FIG. 10 and FIG. 11, the display panel 10 includes an element substrate 510 and an opposite substrate 520 that is arranged so as to face the element substrate 510. The element substrate 510 and the opposite substrate 520 are adhered to each other through a seal material 52 provided at portions surrounding the display area 10*a* so as to maintain a certain gap therebetween. The liquid crystal 105 is sealed in the gap.

The seal material 52 is, for example, made of ultraviolet curing resin, thermosetting resin, or the like. In the manufacturing process, the seal material 52 is applied on any one of the element substrate 510 or the opposite substrate 520 and then cured by ultraviolet irradiation, heating, or the like. In order to maintain the gap (gap between the substrates) between the element substrate 510 and the opposite substrate 520 at a constant value, a gap material such as a glass fiber or a glass bead is mixed to the seal material 52.

In side the area in which the seal material 52 is applied, a window-frame light shielding film 53 having a light shielding property is provided on the side of the opposite substrate 520 so as to define the window-frame area for the display area 10*a*. Note that the window-frame light shielding film 53 may be partially or entirely provided on the side of the element substrate 510.

Within the peripheral area around the display area 10*a*, the X driver 140 and a plurality of external circuit connection terminals 102 are formed along one side of the element substrate 510 in an area outside of the seal material 52. Note that the plurality of external circuit connection terminals 102 are connected through an FPC substrate, or the like, to the timing control circuit 30 and the common signal supply circuit 50, and are supplied with the above described data Dsf, common signals Vcom1 to Vcom4, control signals for the Y driver 130 and X driver 140, and the like. In addition, the Y driver 130 is provided at each of two sides adjacent to the above one side and the scanning lines are driven from both sides. Furthermore, wirings (not shown), or the like, that are shared by the two Y drivers 130 are provided in an area at the remaining one side. Note that the reason why the Y driver 130 is provided at each of two sides and the scanning lines are driven from both sides is because in a configuration that the Y driver 130 is provided only at one side and the scanning lines are driven from one side, the delay of a scanning signal may be problematic. Thus, as far as the delay of a scanning signal is not problematic, the configuration that the Y driver 130 is provided only at one side out of two sides may be employed.

At the four corner portions of the opposite substrate 520, conductive materials 106 for conduction between both substrates are provided in correspondence with the four common electrodes 521*a* to 521*d*. Although not shown in the drawing, the element substrate 510 is provided with conductive terminals at areas facing these corner portions, each of which lead to any one of the external circuit connection terminals 102. In this way, the common electrodes 521*a* to 521*d* of the opposite substrate 520 are configured to be supplied with the common signals Vcom1 to Vcom4 through the external circuit connection terminals 102 of the element substrate 510 and the conductive materials 106, respectively.

Note that on the element substrate 510, after wirings such as the pixel switching transistors, scanning lines and data lines are formed, an alignment layer is formed on the pixel electrodes 118. On the other hand, on the opposite substrate 520, other than the common electrodes, a light shielding film 23 and an alignment layer located in the uppermost layer portion are formed. The liquid crystal 105 is, for example, made of a liquid crystal that mixes one or a few types of nematic liquid crystals and is placed in a predetermined alignment state between the pair of alignment layers.

Here, for easy description, before the opposite substrate 520 of the liquid crystal device 1 is described, the configuration according to the comparative example will be described. FIG. 16 is a plan view that shows the opposite substrate of the liquid crystal device according to the comparative example, showing the side on which the common electrodes are provided is oriented as the front side on the sheet.

As shown in the drawing, the opposite substrate 520 according to the comparative example includes four common electrodes 521*a*, 521*b*, 521*c* and 521*d* that are electrically divided. Of these common electrodes, the common electrode 521*a* corresponding to the first group is formed on a facing surface of the opposite substrate 520 in an area 610*a* that faces the first to 270th row pixel electrodes provided on the element substrate 510. Similarly, the common electrode 521*b* corresponding to the second group, the common electrode 521*c* corresponding to the third group and the common electrode 521*d* corresponding to the fourth group are respectively formed on the facing surface of the opposite substrate 520 and in areas 610*b*, 610*c* and 610*d* that respectively face the 271st to 540th row pixel electrodes, the 541st to 810th row pixel electrodes and the 811th to 1080th row pixel electrodes, which are provided on the element substrate 510. Note that the areas 610*a* (common electrode 521*a*) and 610*b* (common electrode 521*b*) are separated from each other by a separating groove portion 531 formed in the X direction in the drawing. Similarly, the areas 610*b* (521*b*) and 610*c* (521*c*) are separated from each other by a separating groove portion 532, and the areas 610*c* (521*c*) and 610*d* (521*d*) are separated from each other by a separating groove portion 533. Each of the separating groove portions 531 to 533 extends in the X direction on the facing surface of the opposite substrate 520 within the range that overlaps the display area 10*a*.

FIG. 17 is a plan view that shows positional relationship between the arrangement of the pixels in the liquid crystal device according to the comparative example and the separating groove portion 531. As shown in the drawing, the separating groove portion 531 is located between the pixel electrodes 118*a* that belong to the area 610*a* and the pixel electrodes 118*b* that belong to the area 610*b* among the pixel electrodes 118 that are arranged in a matrix in the X and Y directions. In other words, among the first to 270th row pixel electrodes 118*a* in the first group, the 270th row pixel electrodes 118*a* that are arranged at the end of the area 610*a* in the Y direction are separated from the 271st row pixel electrodes 118*b* in the second group via the separating groove portion 531.

Next, electric field distribution in the thus configured comparative example will be described. FIG. 18 and FIG. 19 are end views of a relevant part, illustrating electric field distribution generated between the common electrodes and the pixel electrodes. FIG. 18 shows the end portion of the area 610*a*, which is located adjacent to the area 610*b* in the Y direction. FIG. 19 shows a non-adjacent portion.

As shown in FIG. 18, within the area 610*a*, the common electrode 521*a* located at the end portion in the Y direction is continuous as viewed toward the positive direction (direction of arrow) in the Y direction, whereas the common electrode 521*a* is interrupted by the separating groove portion 531 as viewed toward the negative direction (direction opposite to the direction of arrow) in the Y direction. Thus, when an electric field is generated between the pixel electrodes 118*a* and the common electrode 521*a* in the 270th row pixels located at the end portion in the Y direction within the area 610*a*, the electric field E1, as shown in the drawing, leaks toward the positive direction in the Y direction, but the electric field E1 does not leak toward the negative direction in the Y direction owing to the separating groove portion 531. Thus, when viewed with respect to the central axis of the pixel electrode 118*a*, the electric field E1 is asymmetric in the Y direction.

On the other hand, within the area 610*a*, other than the end portion in the Y direction, the common electrode 521*a* is continuous in the positive and negative directions in the Y direction as shown in FIG. 9. Thus, an electric field E2 generated between the pixel electrodes 118*a* and the common electrode 521*a* within the area 610*a*, other than the end portion in the Y direction partially leaks outward toward the positive and negative directions in the Y direction from the pixel electrodes 118*a* toward the common electrode 521*a* and is symmetric as viewed with respect to the central axis of each pixel electrode, as shown in the drawing.

Thus, electric field distribution generated in the area 610*a* differs between the end portion in the Y direction and portions other than the end portion. Here, the area 610*a* is described, and similarly, electric field distribution generated in each of the areas 610*b*, 610*c* and 610*d* differs between the end portion and portions other than the end portion. Thus, in the liquid crystal device according to the comparative example, electric field distribution at the boundary that separates the common electrode differs from electric field distribution in areas other than the above, so that this difference is likely to be visually recognized.

In order to suppress the above difference in display, in the display panel 10 according to the present embodiment, the common electrode of the opposite substrate 520 is designed as shown in FIG. 12, and a positional relationship between the common electrodes and the pixel electrodes 118 are designed as shown in FIG. 13.

Specifically, the opposite substrate 520 according to the embodiment is the same as the opposite substrate according to the comparative example in that four divided common electrodes 521*a* to 521*d* are provided and these common electrodes 521*a* to 521*d* are electrically isolated from each other by the separating groove portions 531, 532 and 533 that extend in the X direction; however, the opposite substrate 520 according to the embodiment differs from the opposite substrate according to the comparative example in that in each of the common electrodes 521*a* to 521*d*, a plurality of slit portions 523 are provided at equal intervals in the Y direction so as to extend in the X direction. Note that in FIG. 12, the number of slit portions 523 is four per one group common electrode; however, this is simplified for description. Actually, as shown in FIG. 13, in a matrix arrangement of the pixels, the slit portion 523 is provided in each gap between any adjacent rows of the pixel electrodes except the gaps at which the separating groove portions are provided.

Next, electric field distribution according to the embodiment will be described. FIG. 14 and FIG. 15 are views that respectively correspond to FIG. 18 and FIG. 19, and are end views of a relevant part illustrating electric field distribution between the pixel electrodes and the common electrodes.

As shown in FIG. 14, the common electrode 521*a* that faces the pixel electrode 118*a* located at the end portion of the area 610*a* as viewed in the Y direction is interrupted by the slit portion 523 as viewed toward the positive direction in the Y direction (direction of arrow), and is also interrupted by the separating groove portion 531 as viewed toward the negative direction in the Y direction (direction opposite to the direction of arrow). By so doing, even when an electric field is generated between the pixel electrodes 118*a* and the common electrode 521*a* in the 270th row pixels located at the end portion of the area 610*a* in the Y direction, the electric field E3 does not leak in the positive and negative directions in the Y direction and is symmetric in the Y direction as viewed with respect to the central axis of the pixel electrode 118*a*, as shown in the drawing.

On the other hand, as shown in FIG. 15, the common electrode 521*a*-1 that faces the pixel electrodes 118*a* located at portions of the area 610*a*, other than the end portion in the Y direction, are interrupted from the adjacent common electrodes 521*a*-2 by the slit portions 523 as viewed toward the positive direction or negative direction in the Y direction. Thus, when an electric field is generated between the pixel electrodes 118*a* and the common electrode 521*a* in the pixels located at the end portions of the area 610*a* in the Y direction, the electric field E4 is symmetric in the Y direction as viewed with respect to the central axis of the pixel electrode 118*a*, as shown in the drawing.

Thus, in the present embodiment, electric field distribution generated in the area 610*a* is substantially the same between the end portion in the Y direction and portions other than the end portion and therefore is uniform. Here, the area 610*a* is described, and similarly, the areas 610*b*, 610*c* and 610*d* are also made uniform between the end portion and portions other than the end portion. Thus, in the liquid crystal device according to the embodiment, because electric field distribution at the boundary that separates the common electrode is made uniform with electric field distribution in areas other than the boundary, it is less likely to visually recognize a difference in display.

Note that each slit portion 523 preferably extends in the X direction to the area outside the display area 10*a* in terms of reducing generation of asymmetric electric field in the Y direction.

In addition, in the present embodiment, each of the common electrodes 521*a* to 521*d* of the first to fourth groups has a surrounding portion that connects each line outside the area in which the slit portions 523 are provided as shown in FIG. 12, so that a common signal can be supplied equally to each line. Note that it is only necessary that the terminal end portions of each slit portion 523 in the X direction and the length of each slit portion 523 are optimized on the basis of a balance between a reduction in disturbance of electric field and an increase in electric resistance by narrowing the slit portions 523.

In addition, in the present embodiment, except the separating groove portions 531 to 533, the slit portion 523 is provided at each gap between the adjacent pixel electrodes; instead, the slit portion may be provided at every other gap between the adjacent pixel electrodes. In the configuration that the slit portion 523 is provided at every other gap as described above, when focusing on a line, the common electrode is continuous to any one of the positive or negative side in the Y direction, and the slit portion 523 is located on the other side of the positive or negative side in the Y direction. Thus, electric field distribution is made uniform.

In this manner, according to the present embodiment, for example, when one field is driven by being divided into a plurality of sub-fields and a voltage applied to each of the plurality of common electrodes is alternately switched, a deterioration in contrast ratio and a decrease in the number of addressable luminance levels that can be displayed are improved, and disturbance of electric field due to the plurality of divided common electrodes is reduced to thereby make it possible to prevent a decrease in displayed image quality.

3: Method of Manufacturing Opposite Substrate

Next, the method of manufacturing the opposite substrate 520 will be described with reference to FIG. 20A to FIG. 20C and FIG. 21D to FIG. 21F. Note that FIG. 20A to FIG. 20C and FIG. 21D to FIG. 21F show the cross-sectional views of processes that sequentially show major processes of manufacturing the opposite substrate 520 in a substrate for the electro-optical device.

Figure 20A:
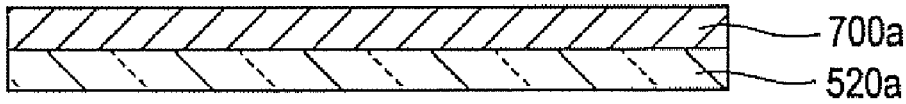
FIG. 20A to FIG. 20C are cross-sectional views of processes of a method of manufacturing a substrate of the liquid crystal device according to the embodiment.

As shown in FIG. 20A, on the surface of a substrate body 520*a* formed of a quartz substrate, or the like, that is, on a facing surface that is one of the faces of the substrate body 520*a*, facing the element substrate 510, when the display panel 10 is assembled, a light shielding metal film 700*a* made of aluminum (Al), chromium (Cr), or the like, is deposited by means of sputtering, or the like.

Figure 20B:
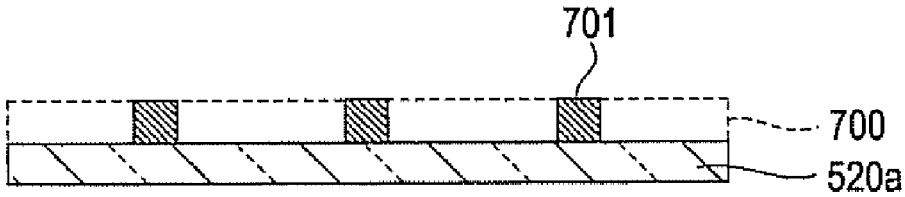

Next, as shown in FIG. 20B, by patterning the metal film 700*a* using a general etching method, a light shielding film 701 having the same width as the slit portion 523 is formed at positions at which the slit portion 523 should be provided. Here, the width of the slit portion 523 is a size of the slit portion 523 in the Y direction (see FIG. 12 or FIG. 13). Note that the above described processes shown in FIG. 20A and FIG. 20B are an example of forming a light shielding film according to the aspects of the invention.

Figure 20C:
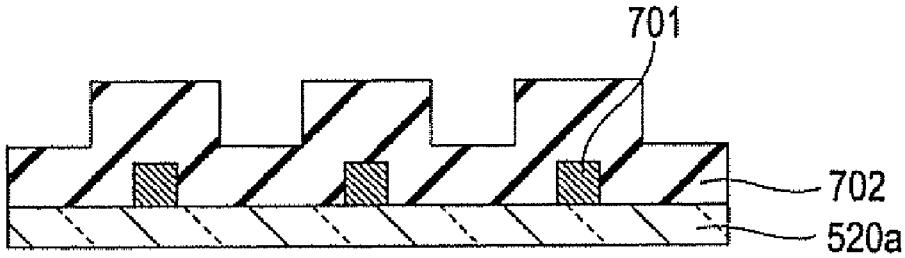

Next, as shown in FIG. 20C, a boro-phospho silicate glass (hereinafter, referred to as "BPSG" where appropriate) film is formed as an interlayer insulating film so as to cover the surface of the substrate body 520*a* and the light shielding film 701 (forming an insulating film according to the aspects of the invention).

Figure 21D:
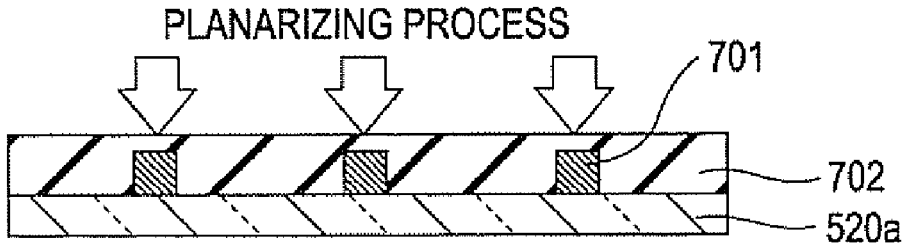
FIG. 21D to FIG. 21F are cross-sectional views of processes of the method of manufacturing the substrate of the liquid crystal device according to the embodiment.

Subsequently, as shown in FIG. 21D, the BPSG film 702 is planarized using a planarizing method such as CMP (planarizing the insulating film according to the aspects of the invention).

Figure 21E:
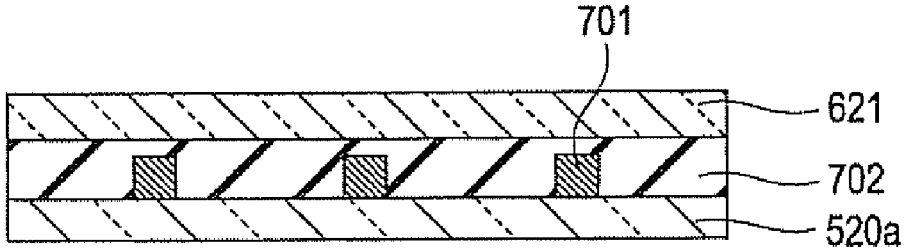

Furthermore, as shown in FIG. 21E, a transparent conductive film 621 made of ITO (indium tin oxide), or the like, is formed on the surface of the planarized BPSG film 702 using a deposition method such as sputtering (forming a transparent conductive film according to the aspects of the invention).

Figure 21F:
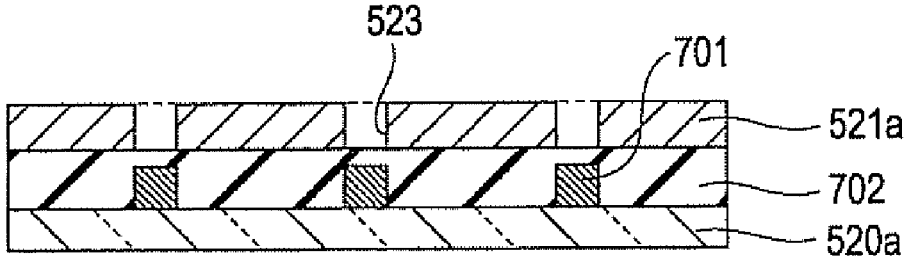

Then, the transparent conductive film 621 is patterned so as to remove portions corresponding to the slit portions 523 and the separating groove portions 531 to 533 by means of, for example, etching to thereby form the common electrodes 521*a* to 521*d* as shown in the plan view of FIG. 12 (removing portions of the transparent conductive film, which overlaps the pattern of the light shielding film according to the aspects of the invention). Then, in the area 610*a*, as shown in FIG. 21F, portions that overlaps the light shielding film 701 are removed to form the common electrode 521*a* having the slit portions 523.

Note that etching of the transparent conductive film 621 may be performed after, first, a negative-type photoresist film is formed to cover the surface of the transparent conductive film 621, second, light is irradiated from the rear face side of the substrate body 520*a* on which a photoresist film has been formed, and, third, the photoresist film is developed. By so doing, within the photoresist film, portions that are not exposed to light owing to the light shielding film 701 are removed through development, and within the transparent conductive film 621, portions that should be removed as the slit portions 523 and the separating groove portions 531 to 533 are exposed. In this manner, etching may be performed. As described above, because the light shielding film 701 by itself is used as a photomask, another photomask is unnecessary.

Then, after the common electrodes 521*a* to 521*d* are patterned, an alignment layer is provided over the display area so as to cover these common electrodes to thereby form the opposite substrate 520. Note that, immediately after the common electrodes are patterned, steps are also formed by the slit portions 523 and the separating groove portions 531 to 533. Thus, it is applicable that these steps are filled with an insulating material, a planarizing process is performed thereon, and then an alignment layer is provided. In this way, when an alignment layer is provided after the steps formed by the slit portions 523 and the separating groove portions 531 to 533 are planarized, it is possible to further enhance alignment of the liquid crystal.

As described above, according to the manufacturing method of the present embodiment, it is possible to manufacture the opposite substrate on which the common electrodes, each of which has slit portions and which are divided into a plurality of groups by the separating groove portions, are simply and accurately formed.

4: Electronic Apparatus

Figure 22:
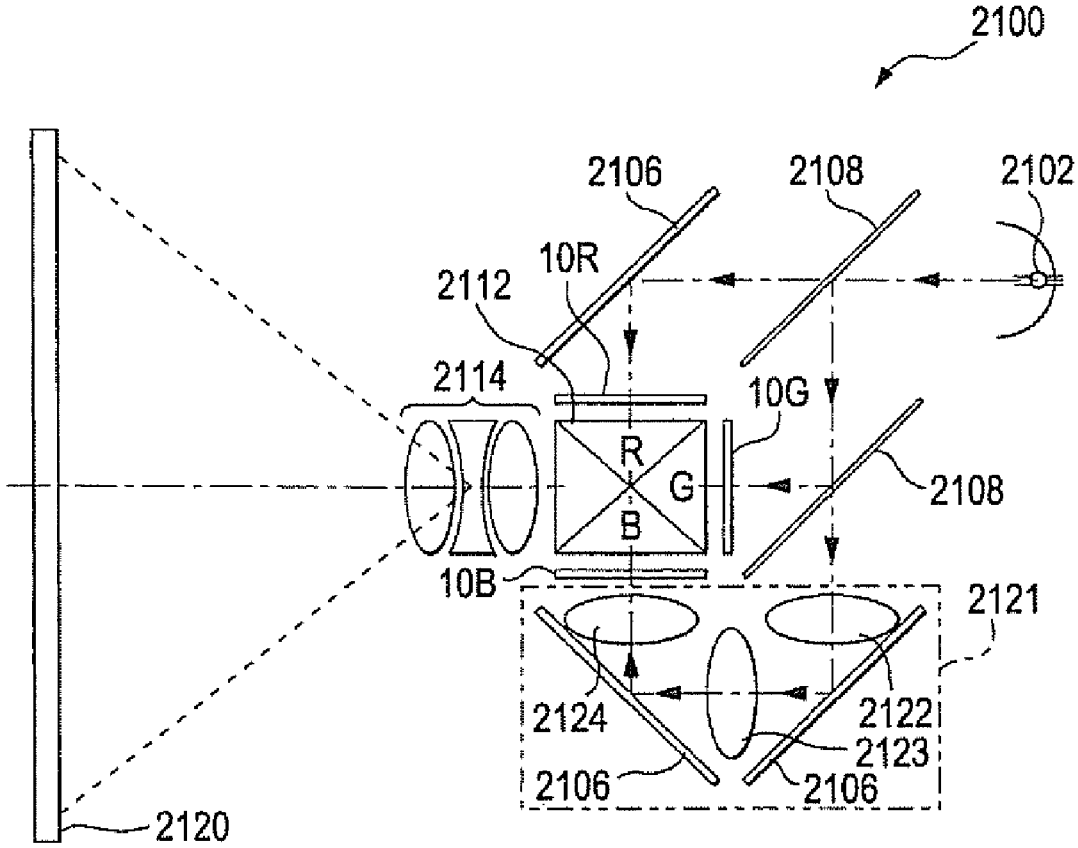
FIG. 22 is a view that shows the configuration of a projector that employs the liquid crystal device.

Next, as an example of an electronic apparatus that uses the electro-optical device according to the above described embodiment, a projector that uses the above described display panel 100 as a light valve will be described. FIG. 22 is a plan view that shows the configuration of the projector. As shown in the drawing, a lamp unit 2102 formed of a white light source such as a halogen lamp is provided inside the projector 2100. Light projected from the lamp unit 2102 is split into three primary colors, that is, R (red), G (green) and B (blue), by three mirrors 2106 and two dichroic mirrors 2108, which are arranged inside, and then guided to light valves 10R, 10G and 10B corresponding to the primary colors. Note that B color light has a longer optical path as compared with the other R color or G color, so that to prevent a loss due to the longer optical path, B color light is guided through a relay lens system 2121 formed of an incident lens 2122, a relay lens 2123 and an exit lens 2124.

In the projector 2100, three sets of liquid crystal devices each of which includes the display panel 10 are provided in correspondence with colors of R, G and B, and image data corresponding to colors of R, G and B are respectively supplied from the external upper level circuit. The configuration of each of the light valves 10R, 10G and 10B is the same as that of the display panel 10 according to the above described embodiment, and they are driven respectively in each subfield by data of R, G, and B supplied from the timing control circuit (not shown in FIG. 22) provided in correspondence with the colors. Light modulated by these light valves 10R, 10G and 10B enters a dichroic prism 2112 from the three directions. In the dichroic prism 2112, R color light and B color light are refracted at a right angle while, on the other hand, G color light goes straight. Thus, by composing images corresponding to the respective colors, a color image is projected onto a screen 2120 through a projection lens 2114.

Note that, because rays of light corresponding to the primary colors of R, G, B enter the light valves 10R, 10G and 10B by the dichroic mirrors 2108, no color filter needs to be provided. In addition, an image transmitted through the light valve 10R or 10B is reflected by the dichroic prism 2112 and then projected, whereas an image transmitted through the light valve 10G is directly projected. Thus, the horizontal scanning direction of the light valves 10R and 10B is inverted to the horizontal scanning direction of the light valve 10G, and an image flipped horizontally is displayed.

The electronic apparatus may be, in addition to the projector described with reference to FIG. 22, a television, a viewfinder-type or direct-view-type video tape recorder, a car navigation system, a pager, a personal organizer, an electronic calculator, a word processor, a workstation, a video telephone, a POS terminal, a digital still camera, a cellular phone, or devices provided with a touch panel. Then, needless to say, the liquid crystal device according to the aspects of the invention may be applied to these various electronic apparatuses.

The entire disclosure of Japanese Patent Application Nos: 2007-307627, filed Nov. 28, 2007, 2008-57402, filed Mar. 7, 2008, 2008-57409, filed Mar. 7, 2008 and 2008-132209, filed May 20, 2008 are expressly incorporated by reference herein.

What is claimed is:

1. A driving circuit of an electro-optical device that includes:

scanning lines divided into two or more groups each including a predetermined number of scanning lines;

data lines that intersect the scanning lines;

pixels including pixel electrodes disposed at positions corresponding to intersections of the scanning lines and the data lines;

two or more common electrodes that correspond to the two or more groups of scanning lines; and a liquid crystal that is held between the pixel electrodes and the common electrodes;

wherein the driving circuit divides one field of one of the pixels into sub-fields and applies the one of the pixels with on or off voltages during the sub-fields to achieve a desired gray-scale level, the driving circuit comprising:

a common signal supply circuit that supplies a common signal of either one of a first voltage and a second voltage different from the first voltage to each of the common electrodes;

a scanning line driving circuit that selects the scanning lines; and a data line driving circuit that supplies a pixel located on the selected scanning line with an on voltage or an off voltage as a data signal through the data line that corresponds to the pixel, the supplied on voltage or off voltage corresponding to the gray-scale level specified for the pixel and to the current sub-field, wherein:

during one specific sub-field, the data line driving circuit supplies a data signal of an off voltage regardless of the gray-scale level for the pixel, and after the specific sub-field ends, the common signal supply circuit switches a voltage applied to a common electrode of the two or more common electrodes, the common electrode of the two or more common electrode corresponding to the group of scanning lines that includes the selected scanning line, the common signal supply circuit switching the voltage from a first voltage to a second voltage that is different from the first voltage.

2. The driving circuit of the electro-optical device according to claim 1, wherein the number of the scanning lines that form each group is equal.

3. The driving circuit of the electro-optical device according to claim 1, wherein the sub-field having the shortest period among the plurality of sub-fields, into which the one field is divided, except the specific sub-field is arranged following the specific sub-field.

4. An electro-optical device comprising:

scanning lines divided into two or more groups each including a predetermined number of scanning lines;

data lines that intersect the scanning lines;

pixels including pixel electrodes disposed at positions corresponding to intersections of the scanning lines and the data lines;

two or more common electrodes that correspond to the two or more groups of scanning lines; and a liquid crystal that is held between the pixel electrodes and the common electrodes;

a driving circuit divides one field of one of the pixels into sub-fields and applies the one of the pixels with on or off voltages during the sub-fields to achieve a desired gray-scale level, the driving circuit including:

a common signal supply circuit that supplies a common signal of either one of a first voltage and a second voltage different from the first voltage to each of the common electrodes;

a scanning line driving circuit that selects the scanning lines; and a data line driving circuit that supplies a pixel located on the selected scanning line with an on voltage or an off voltage as a data signal through the data line that corresponds to the pixel, the supplied on voltage or off voltage corresponding to the gray-scale level specified for the pixel and to the current sub-field, wherein:

during one specific sub-field, the data line driving circuit supplies a data signal of an off voltage regardless of the gray-scale level for the pixel, and after the specific sub-field ends, the common signal supply circuit switches a voltage applied to a common electrode of the two or more common electrodes, the common electrode of the two or more common electrode corresponding to the group of scanning lines that includes the selected scanning line, the common signal supply circuit switching the voltage from a first voltage to a second voltage that is different from the first voltage.

5. The electro-optical device according to claim 4, wherein the liquid crystal is held between a first substrate on which the pixel electrodes are provided and a second substrate on which the common electrodes corresponding to the groups are provided, and wherein the common electrodes each have a slit portion that is open at a portion facing a gap between the adjacent pixel electrodes and that is provided for every or every other scanning lines belonging to each group.

6. The electro-optical device according to claim 5, wherein the common electrode corresponding to one of the groups has a surrounding portion outside an area in which the slit portions are provided.

7. An electronic apparatus comprising the electro-optical device according to claim 4.

8. A method of driving an electro-optical device that includes:

scanning lines divided into two or more groups each including a predetermined number of scanning lines;

data lines that intersect the scanning lines;

pixels including pixel electrodes disposed at positions corresponding to intersections of the scanning lines and the data lines;

two or more common electrodes that correspond to the two or more groups of scanning lines; and a liquid crystal that is held between the pixel electrodes and the common electrodes;

wherein the method divides one field of one of the pixels into sub-fields and applies the one of the pixels with on or off voltages during the sub-fields to achieve a desired gray-scale level, the method comprising:

supplying a common signal of either one of a first voltage and a second voltage different from the first voltage to each of the common electrodes;

selecting the scanning lines;

supplying a pixel located on the selected scanning line with an on voltage or an off voltage as a data signal through the data line that corresponds to the pixel, the supplied on voltage or off voltage corresponding to the gray-scale level specified for the pixel and to the current sub-field;

during one specific sub-field, supplying a data signal of an off voltage regardless of the gray-scale level for the pixel; and after the specific sub-field ends, switching a voltage applied to a common electrode of the two or more common electrodes, the common electrode of the two or more common electrode corresponding to the group of scanning lines that includes the selected scanning line, from a first voltage to a second voltage that is different from the first voltage.

* * * * *